US007123164B2

(12) United States Patent
Zoladek et al.

(10) Patent No.: US 7,123,164 B2
(45) Date of Patent: Oct. 17, 2006

(54) VEHICLE TELEMETRIC SYSTEM

(75) Inventors: Jacek Grzegorz Zoladek, Ottawa (CA); Colin David Goodall, Carleton Place (CA); Douglas John Preece, Clayton (CA); Gary Thomas Pepper, Ashton (CA)

(73) Assignee: Netistix Technologies Corporation, Kanata (CA)

( * ) Notice: Subject to any disclaimer, the term of this patent is extended or adjusted under 35 U.S.C. 154(b) by 304 days.

(21) Appl. No.: 10/909,007

(22) Filed: Aug. 2, 2004

(65) Prior Publication Data

US 2006/0022842 A1 Feb. 2, 2006

(51) Int. Cl.
*G08C 19/22* (2006.01)

(52) U.S. Cl. ..... 340/870.07; 701/33; 701/29; 701/32; 455/424

(58) Field of Classification Search ..... 340/870.07, 340/425.5; 701/33, 29, 32; 455/424
See application file for complete search history.

(56) References Cited

U.S. PATENT DOCUMENTS

| | | | | |
|---|---|---|---|---|
| 5,564,070 | A | 10/1996 | Want | |
| 5,742,914 | A | 4/1998 | Hagenbuch | |
| 5,758,300 | A * | 5/1998 | Abe | 455/424 |
| 6,263,268 | B1 | 7/2001 | Nathanson | |
| 6,295,492 | B1 * | 9/2001 | Lang et al. | 701/33 |
| 6,429,773 | B1 | 8/2002 | Schuyler | |
| 6,560,516 | B1 | 5/2003 | Baird | |
| 6,604,033 | B1 | 8/2003 | Banet | |
| 6,611,740 | B1 | 8/2003 | Lowrey | |
| 6,636,790 | B1 | 10/2003 | Lightner | |
| 6,850,823 | B1 | 2/2005 | Eun | |
| 6,956,501 | B1 * | 10/2005 | Kitson | 340/870.07 |

FOREIGN PATENT DOCUMENTS

| | | |
|---|---|---|
| CA | 2414126 | 12/2000 |

* cited by examiner

*Primary Examiner*—Albert K. Wong
(74) *Attorney, Agent, or Firm*—Victoria Donnelly; IP-MEX Inc.

(57) ABSTRACT

A vehicle telemetric system comprises vehicle interface units (VIUs), wireless gateways, and a central host. The VIU in a vehicle collects data over the OBD-II bus and stores the data in the form of Data Point Records (DPRs) in an on-board flash memory. When the VIU is within wireless range of a gateway, it establishes a WiFi (802.11b) connection with the gateway, and submits stored DPRs to the gateway, to be stored in permanent storage at the gateway. The gateways communicate with the central host over a wide area network (WAN). When a gateway has gathered new DPRs from a VIU, it submits these to the central host. Databases in the gateways as well as in the central host are maintained and synchronized to track received DPRs by sequence number and originating VIU. In conjunction with specific protocols, all DPRs are thus collected reliably, even though communication with a vehicle may be intermittent. Efficient use of WiFi bandwidth is made by avoiding the unnecessary collection of duplicate DPRs.

31 Claims, 11 Drawing Sheets

904

| |
|---|
| Record ID |
| VIU Serial Number |
| Gateway Host |
| Data Ready Rec ID |
| Data Ready Rec Count |
| Completed Rec ID |
| Completed Rec Count |
| Entry State |
| Date and Time |

FIG. 9b

902

| |
|---|
| Record ID |
| Serial Number |
| VIU Type |
| Programmed Profile |
| Present Profile |
| Last Data Record Transferred |
| Last Transfer Time |
| Last Sync Time |
| VIN |
| License |
| VIU State |
| Time Stamp |

FIG. 9a

VEHICLE TELEMETRIC SYSTEM

FIELD OF THE INVENTION

The invention relates to motor vehicle telemetric systems, in which an on-board computer transmits vehicle related data to a central host computer over a wireless network.

BACKGROUND OF THE INVENTION

Most motor vehicles have in recent years been equipped with on-board computers connected to sensors located in various systems in the motor vehicle, for example the engine, the exhaust system, and the like.

The Society of Automotive Engineers (SAE) has set standards which include a standard connector plug and a set of diagnostic test signals that technicians use when adjusting or repairing the motor vehicle. The standard connector plug and set of test signals, today, is known collectively as OBD-II (On-Board-Diagnostic, version 2) which applies to all cars and light trucks built after Jan. 1, 1996.

The on-board computers may also be coupled through the OBD-II interface to an on-board equipment containing a wireless modem, and thence to a wireless communications network to enable interested parties to remotely obtain diagnostic and other information from the motor vehicle. The applications for accessing the vehicle on-board computers remotely include highway monitoring of emission levels, and surveillance of fleet vehicles from a central location for purposes of performance tracking and maintenance scheduling.

Depending on the application, various ways are possible in which the wireless connectivity between the vehicle and a computer host at a monitoring location (to be referred to as the central host) can be achieved. For example the wireless modem may be configured to operate in the manner of a cellular telephone, and use the cellular telephone network to connect to any central host equipped with access to the telephone network. Similarly, the wireless modem may be configured to access the central host over a Wide Area Network (WAN), for example the internet. A system for transmitting, collecting and displaying diagnostic and operational information from one or more motor vehicles to a central server connected to a wide area network, is described in U.S. Pat. No. 6,295,492, issued to Lang, et al.

A problem of access may arise, due to the reliance on a single wireless network between the vehicle and the central host. As a practical matter, and due to the nature of being a vehicle, the vehicle may travel between many locations. The use of a single, virtually ubiquitous, wireless network is possible in principle (viz. the cellular telephone network, or a satellite based network), but the use of such a network for frequent and regular access to a potentially very large number of vehicles is both expensive and wasteful of resources.

This problem may be circumvented by deploying a number of remote computers (such as reference 27 in FIG. 1 of the U.S. Pat. No. 6,295,492 cited above), connected to the central host by conventional means, e.g. the land-line based internet. Each remote computer serves as a wireless gateway (WAP or wireless access point) to a localized wireless network. The Institute of Electrical and Electronic Engineers (IEEE) Standard 802.11b describes protocol for use in a Wireless Local Area Network (WLAN). If the system is based on the IEEE 802.11b Standard, the on-board modem accesses the nearest compatible remote computer and through it achieves data communication with the central host.

Other patents describing similar remote vehicle diagnostic systems, or aspects of such systems, include; U.S. Pat. No. 6,604,033, issued to Banet, et al.; U.S. Pat. No. 6,611,740, issued to Lowrey, et al.; and U.S. Pat. No. 6,636,790, issued to Lightner, et al.

It is generally understood that WLANs of the kind described above have a very limited geographic reach, on the order of a few 100 meters at most. There is not a continuous geographic coverage of WLANs, and a vehicle may frequently be outside the reach of any WAP. Nevertheless, WLANs for the purpose of providing wireless access for vehicles for remote performance monitoring, diagnostics, or exhaust emissions performance checks, may be established at vehicle repair facilities, in parking lots, at high way toll plazas, etc. Furthermore, not every WLAN is designed or intended to operate with all vehicles. In general, WLAN devices (i.e. the vehicle's on-board computer) must be authorized and be registered by the WLAN master (also referred to as WLAN gateway) before communication is possible.

The vehicle's on-board computer may store vehicle data in its memory during periods when the vehicle is not within reach of a designated WLAN. In a conventional application, for example when the vehicle is in a repair shop being serviced, there is no problem collecting all data. However in a general surveillance or remote monitoring application, where the vehicle is free to roam, the driver may not even be aware of the data collection taking place, or of the boundaries of a WLAN the modem in the vehicle is currently accessing. In this case, the time for wireless accessibility may be short, frequently interrupted, and occur at a number of different WAPs successively.

A method, directly applicable to vehicle telemetry is disclosed in Canadian Patent 2,414,126, issued to Nader, et al. In this system a specific protocol (Internet Protocol IP version 6) is used which can provide a virtual continuous data path (connection) between the vehicle and the central host regardless of which WLAN the vehicle is currently accessing. While providing an elegant way of "hiding" the problem, thus possibly simplifying software design at the host, this solution does not address the practical aspects of providing continuity of information using a generally available protocol (IP version 4) nor does it take into account the uncertain, often intermittent, presence of vehicles within reach of a WLAN.

There exists thus a problem to ensure continuity of the effective data communication between the vehicle and the central host.

This problem is partially solved, in a different context (hand-held personal computing devices, rather than vehicles) in a system described in U.S. Pat. No. 5,564,070, issued to Want, et al. In this system, the main flow of information is from the central host to the mobile device. Stationary computers, attached to a WLAN gateway, are used to temporarily hold or buffer data from the central host and destined for the mobile device, while the mobile device is out of reach for brief periods of time.

In the case of the motor vehicle telemetric system however, the main flow of information is the reverse, from the vehicle to the central host. The method described in the above cited U.S. Pat. No. 5,564,070 for providing continuity of communication is thus not directly applicable to the problem of providing continuity of information in a motor vehicle telemetric system.

What needs to be developed is a method for providing continuity of information in a vehicle telemetric system over localized wireless networks (WLANs), to permit a central host to collect diagnostic and other data from a vehicle, even when wireless access is intermittent.

SUMMARY OF THE INVENTION

It is an objective of the present invention to provide a vehicle telemetric system, which would avoid or reduce the above mentioned drawbacks.

According to one aspect of the invention there is provided a vehicle telemetric system, comprising:

a central host connected to a communications network;

one or more gateways connected to the communications network, the communications network enabling the transfer of packet data between the gateways and the central host;

a vehicle interface unit (VIU) within a vehicle having access to sensors in the vehicle for collecting vehicle related data, the VIU having means for communication over a wireless link of any of said gateways when the vehicle is within a transmission range of one of said gateways;

the VIU further comprising means for aggregating and formatting the vehicle related data into a data point record (DPR) including a unique sequence number and a vehicle identification number;

the VIU having a memory for storing a list of DPRs, and a VIU means for forwarding the DPRs to the one of said gateways over the wireless link;

each gateway having another memory for storing the DPRs received from the VIU, and a gateway means for forwarding the DPRs to the central host; and the central host having means for storing DPRs generated by the VIU and received from all gateways, and means for notifying each gateway regarding the sequence numbers and the vehicle identification numbers of the DPRs that have been already received at the central host.

Beneficially, the DPR is of a size designed to fit into the payload of a layer 3 (network layer) packet, which in turn fits into a single packet of the wireless layer 2 (data link layer) protocol used for communicating over the wireless link. Advantageously, the wireless link is a short range wireless link, the layer 2 protocol used for communicating over the wireless link is the 802.11b protocol, and the layer 3 protocol used for communicating between the VIU and the gateway is the Internet Protocol (IP). Conveniently, the size of each DPR transmitted in accordance with the 802.11b protocol is limited to approximately 1024 bytes.

In the vehicle telemetric system, the VIU means for forwarding comprises means for forwarding selected DPRs as instructed by the one of said gateways, preferably in reverse order, starting with the most recently aggregated DPR.

The means in the VIU for communication over the wireless link comprises announcement means for generating an announcement packet, including the sequence number of the most recent DPR, and a counter identifying how many DPRs are available to be forwarded to the one of said gateways. The announcement means comprises timing means for repeatedly transmitting said announcement packet at a time interval as long as the wireless link is activated. Conveniently, the timing means comprises means for changing the time interval to a longer time interval after a predetermined number of announcement packets have been sent.

In the described vehicle telemetric system, the DPR includes the following fields:

a header comprising a VIU serial number, a data length fields indicating the amount of vehicle related data aggregated in the DPR; and a data field, including a number of data points, each data point including an encoded data and a time offset at which the encoded data was collected from the vehicle.

The central host of the vehicle telemetric system comprises means for identifying gaps in continuity in the sequence numbers of the received DPRs (the missing DPRs) and informing the gateways of the gaps, and the gateways comprise means for requesting the missing DPRs from the VIU when the vehicle is within the respective transmission range.

In the vehicle telemetric system as described above, the VIU means for forwarding comprises a means for forwarding a first set of the DPRs to the one of said gateways over the wireless link when the wireless link is activated, and for forwarding a second set of the DPRs to another of said gateways over another wireless link when the another wireless link is activated, so that the first and second sets of DPRs form the complete said list of DPRs.

According to another aspect of the invention, there is provided a vehicle interface unit (VIU) for a vehicle telemetric system, comprising a central host connected to a communications network and one or more gateways connected to the communications network, which enables the transfer of packet data between the gateways and the central host, the VIU being located in a vehicle and having access to sensors in the vehicle for collecting vehicle related data, the VIU having means for communication over a wireless link with any of said gateways, the wireless link being activated when the vehicle is within a transmission range of the one of said gateways, and another wireless link being activated when the vehicle is within a transmission range of another one of said gateways;

the VIU further comprising a means for aggregating and formatting the vehicle related data into a list of data point records (DPRs), each DPR including a unique sequence number and a vehicle identification number;

the VIU having a memory for storing the DPRs, and a VIU means for forwarding a first set of the DPRs to the one of said gateways over the wireless link when the wireless link is activated, and for forwarding a second set of the DPRs to said another of said gateways over the another wireless link when the another wireless link is activated, so that the first and second sets of DPRs form the complete said list of DPRs.

In the VIU described above, the DPR is of a size designed to fit into the payload of a layer 3 (network layer) packet, which in turn fits into a single packet of the wireless layer 2 (data link layer) protocol used for communicating over the wireless link, e.g. the layer 2 protocol used for communicating over the wireless link being the 802.11b protocol, and the layer 3 protocol used for communicating between the VIU and the gateway being the Internet Protocol (IP).

According to yet another aspect of the invention there is provided an access system for use in a vehicle telemetric system, the telemetric system comprising a central host connected to a communications network, the access system comprising:

one or more vehicle interface units (VIUs) and a gateway, the gateway being connected to the communications network, each VIU being located in a different vehicle and having access to sensors in the vehicle for collecting vehicle related data, each VIU having means for communication over a wireless link with the gateway, the wireless link being activated when the vehicle is within a transmission range of the gateway;

the VIU further comprising a means for aggregating and formatting the vehicle related data into a data point record (DPR) including a unique sequence number and a vehicle identification number;

each VIU having a memory for storing the DPRs in a list, and a VIU means for forwarding the DPRs to the gateway over the wireless link;

the gateway having another memory for storing the DPRs received from the VIU and a gateway means for forwarding the DPRs to the central host; and the gateway having means for requesting missing DPRs from each VIU, where the missing DPRs are those that have not been received by the central host.

In the access system described above, the VIU means for forwarding comprises a means for forwarding a first set of the DPRs to the gateway over the wireless link when the wireless link is activated, and for forwarding a second set of the DPRs to the gateway over the wireless link when the wireless link is activated at another time, so that the first and second sets of DPRs form the complete said list of DPRs.

According to one more aspect of the invention there is provided a method for monitoring a vehicle's performance in a vehicle telemetric system comprising a central host connected to a communications network, one or more gateways connected to the communications network, each gateway having a wireless transmission range, a vehicle interface unit (VIU) within a vehicle having access to sensors in the vehicle for collecting vehicle related data, the VIU having means for wireless communication with any of said gateways, the method comprising the steps of:

(a) in the VIU, collecting, aggregating and formatting the vehicle related data into data point records (DPR), each DPR including a unique sequence number and a vehicle identification number, and storing the DPRs as a list in a VIU memory;

(b) determining if the VIU is within the wireless transmission range of one of the gateways;

(c) forwarding a set of the DPRs from the VIU to the one of said gateways over a wireless link;

(d) forwarding some or all of the set of the DPRs received by the one of said gateways from the one of said gateways to the central host over the communications network; and (e) notifying each gateway by the central host regarding the sequence numbers and the vehicle identification numbers of the DPRs that have been already received at the central host.

In the method described above, the step (a) comprises formatting the vehicle related data into the DPRs, each DPR being of a size designed to fit into the payload of a layer 3 (network layer) packet, which in turn fits into a single packet of the wireless layer 2 (data link layer) protocol used for communicating over the wireless link. Beneficially, the step (c) comprises forwarding selected DPRs as instructed by the one of said gateways, e.g. in reverse order, starting with the most recently aggregated DPR.

Advantageously, the method further comprises the step of generating an announcement packet by the VIU and sending it to the one of said gateways, the announcement packet including the sequence number of the most recent DPR, and a counter identifying how many DPRs are available to be forwarded to the one of said gateways, the step being performed before the step (c). Beneficially, the step of generating the announcement packet comprises generating the announcement packet repeatedly at a time interval as long as the wireless link is activated. Conveniently, the step of generating the announcement packet repeatedly comprises changing the time interval to a longer time interval after a predetermined number of announcement packets have been sent.

In the method described above, the step (e) comprises the step of identifying gaps in continuity in the sequence numbers of the received DPRs (the missing DPRs) and informing the gateways of the gaps, and the step (c) comprises requesting the missing DPRs from the VIU when the vehicle is within the respective transmission range.

Advantageously, the step (c) of the method comprises forwarding a first set of the DPRs to the one of said gateways over the wireless link when the wireless link is activated, and for forwarding a second set of the DPRs to another of said gateways over another wireless link when the another wireless link is activated, so that the first and second sets of DPRs form the complete said list of DPRs.

Conveniently, the step (d) comprises changing the format of the DPRs received by the one of said gateways before the DPRs are forwarded to the central host over the communications network, e.g. from a binary representation of the DPR to an ASCII representation.

BRIEF DESCRIPTION OF THE DRAWINGS

The invention will now be described in greater detail with reference to the attached drawings, in which:

FIG. 9*a* shows the record format of a Central VIUS Table 902 of the vehicle telemetric system 10;

FIG. 9*b* shows the record format of a Central Registry Table 904 of the vehicle telemetric system 10;

DETAILED DESCRIPTION OF THE PREFERRED EMBODIMENT

Figure 1:
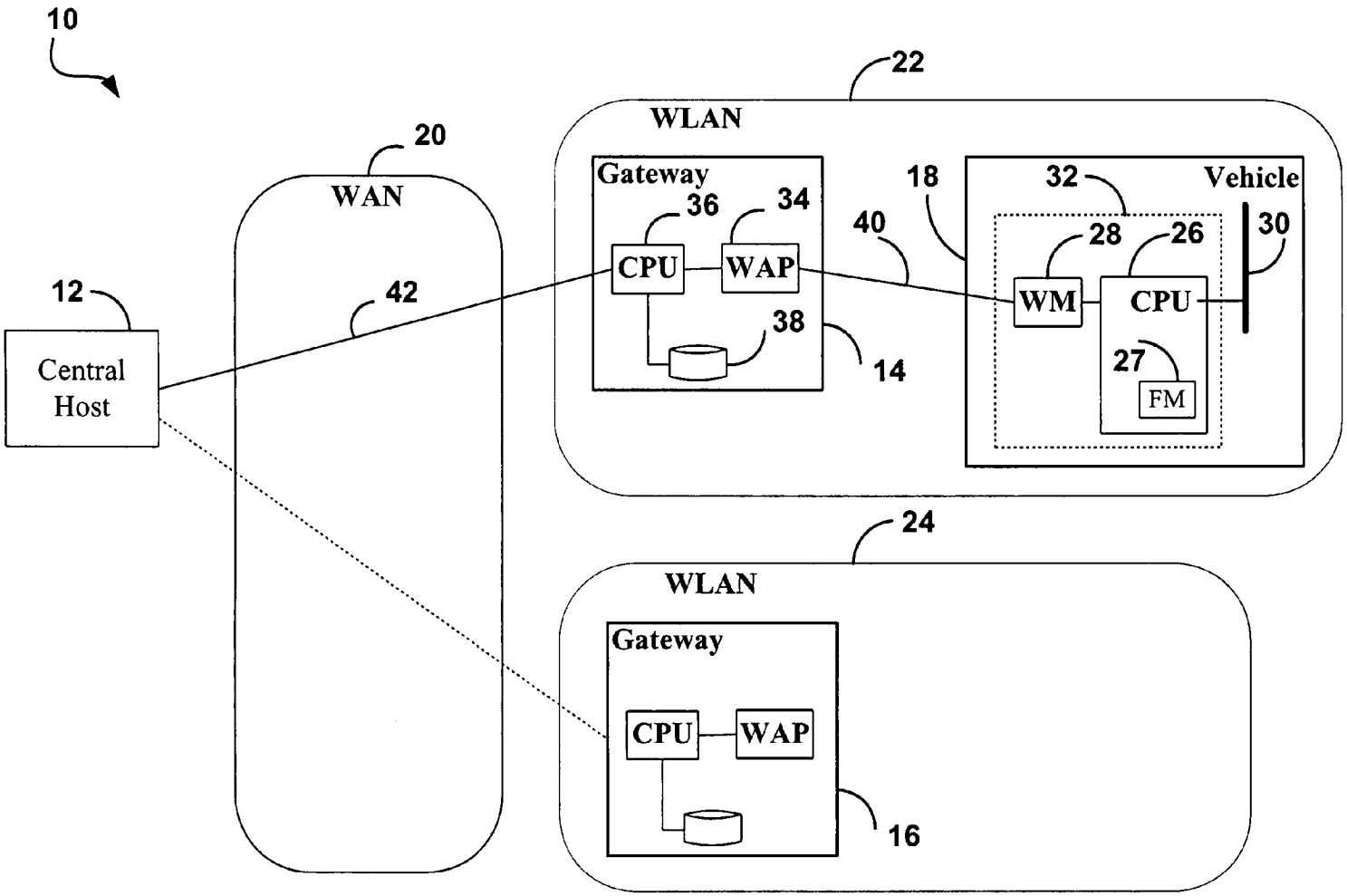
FIG. 1 shows the architecture of a vehicle telemetric system 10.

FIG. 1 shows the architecture of a vehicle telemetric system 10, including a central host 12; a first gateway 14; a second gateway 16; and a vehicle 18. The second gateway 16 is similar to the first gateway 14. The gateways 14 and 16 are connected with the central host 12 over a wide area network (WAN) 20. The coverage area of a first Wireless Local Area Network (WLAN) 22 exists around the first gateway 14. Similarly, the coverage area of a second WLAN 24 exists around the second gateway 16.

The vehicle 18 is shown inside the coverage area of the first WLAN 22, and thus within reach of the first gateway 14.

The vehicle telemetric system 10 may include additional gateways (not shown) having additional coverage areas of additional WLANs (not shown), and includes additional vehicles (not shown).

At some other time (not shown) the vehicle 18 is inside the coverage area of the second WLAN 24, and thus within reach of the second gateway 16.

At yet another time (not shown), the vehicle 18 may be outside the coverage area of the WLANs 22 and 24, and also outside the coverage area of the any other WLAN of the vehicle telemetric system 10. In this case the vehicle is not within reach of any gateway.

The vehicle 18 includes a Vehicle Interface Unit (VIU) 32 comprising a VIU computer (CPU) 26 having a flash memory (FM) 27 and a wireless modem (WM) 28 (VIU means for forwarding data wirelessly). The vehicle 18 further includes a vehicle bus (e.g. OBD-II) 30. The VIU computer 26 is connected to the wireless modem 28, and to the vehicle bus 30.

The first gateway 14 includes a wireless access point (WAP) 34, a gateway computer 36 (gateway means for forwarding data), and a gateway storage 38. The gateway storage 38 is preferably implemented as permanent storage on a hard disk. The gateway computer 36 is connected to the wireless access point (WAP) 34 and the gateway storage 38.

Similarly, the second gateway 16 and any additional gateways (not shown) each include a WAP and a gateway computer with data storage.

When (as shown in FIG. 1) the vehicle 18 is within reach of the first gateway 14, a Wireless Fidelity (WiFi) link 40 may be established between the VIU computer 26 in the vehicle 18 and the gateway computer 36 in the gateway 14, by way of the wireless modem 28 and the WAP 34.

The combination of the VIU 32 and the gateway 14, may be termed an access system for collecting data from the vehicle and uploading the data to the central host 12 when the VIU 32 is in wireless communication with the gateway 14.

In the preferred embodiment, the WLANs 22, 24, and the additional WLANs, of the vehicle telemetric system 10 operate according to the IEEE 802.11b wireless LAN standard, and accordingly the wireless modem 28 of the vehicle 18, and the WAPs of all gateways, including the WAP 34 of the gateway 14, follow the same standard.

A central connection 42 may be established between central host 12, and the gateway computer 36 in the gateway 14, by way of the WAN 20. The establishment of the central connection 42 from time to time is automatic, according to the state of the art. For the purposes of this description, the central connection 42 is assumed to exist whenever it is needed. In the preferred embodiment, the WAN 20 is the Internet.

General Operation of the Vehicle Telemetric System

The operation of the vehicle telemetric system 10 will first be described in general terms, with the aid of FIGS. 2 and 3, from the perspective of the single vehicle 18.

In this description, the term "the gateway" will refer to the first gateway 14, unless the second gateway 16 or other additional gateways are specifically referred to.

The VIU 32 in the vehicle 18, whether within wireless transmission range of a gateway or not, is programmed to periodically collect vehicle data from the vehicle bus 30, and store the data in the flash memory 27 of the CPU 26. The data is aggregated in the form of a list of Data Point Records (DPR).

Figure 2:
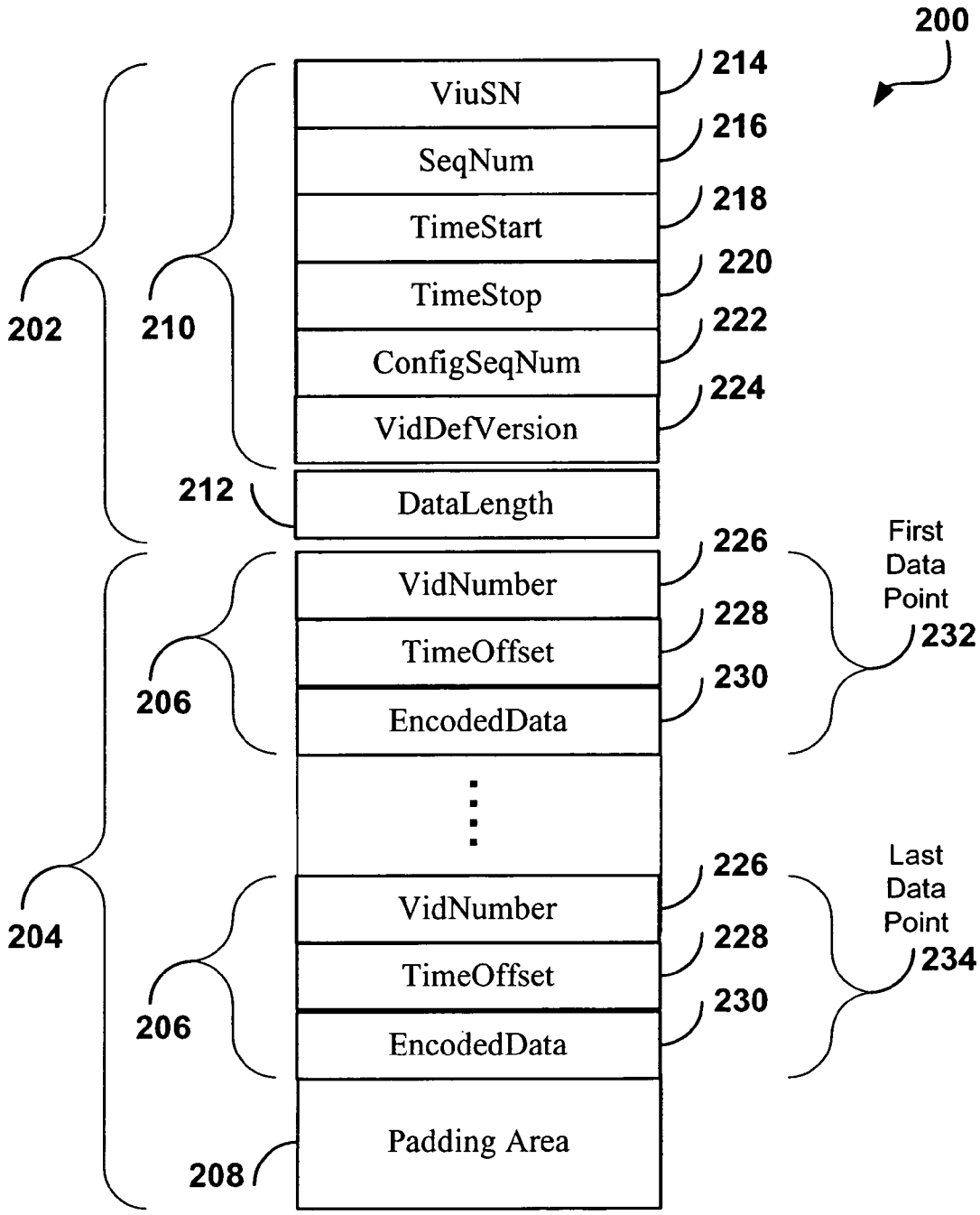
FIG. 2 illustrates the format of a Data Point Record (DPR) 200 used in the vehicle telemetric system 10.

FIG. 2 illustrates the format of a Data Point Record (DPR) 200, which is a hierarchical structure comprised of a Type2RecordInfo field 202 and a Data field 204, the Data field 204 including a number of Data Points 206 and a padding area 208.

The Type2RecordInfo field 202 itself is divided into two fields, a RecordInfo field 210 and a DataLength field 212.

The RecordInfo field 210 in turn is divided into the following fields:

a ViuSN field 214;
a SeqNum field 216;
a TimeStart field 218;
a TimeStop field 220;
a ConfigSeqNum field 222; and
a VidDefVersion field 224.

The Data field 204 has a fixed length of 987 octets, and is used to hold a variable number of DataPoint fields 206. Each DataPoint field 206 comprises three fields: a VidNumber field 226; a TimeOffset field 228; and an EncodedData field 230 having a fixed length of 24 octets.

The overall length of the DPR 200 is 1024 octets and has been chosen so that it can be conveniently and efficiently transported in the payload of a standard layer 3 (network layer) packet (IP packet), carried in the payload of a single layer 2 (data link layer) packet of the wireless protocol (wireless Ethernet).

The meaning and usage of the fields of the DPR 200 are as follows. As vehicle information that is monitored by the VIU 32, it is stored as consecutively numbered data point records (DPR) 200 in the flash memory 27 of the CPU 26.

The RecordInfo field 210 of the Type2RecordInfo field 202 contains information that is specific to the VIU and common to the Data Points 206 that are contained in the Data field 204. The DataLength field 212 of the Type2RecordInfo field 202 indicates the number of octets actually used for Data Points 206 in the Data field 204. The DataLength field 212 may be set to 0 if the first octet following the last octet of the last DataPoint 206 is set to NULL. The first and last Data Points 206 in the Data field 204 are also referenced as 232 and 234 respectively.

The individual fields 214–224 of the RecordInfo field 210 indicate the following. The ViuSN field 214 contains the serial number of the VIU 32 that generated the Data Point Record 200. It is stored as a NULL terminated ASCII string.

The SeqNum field 216 contains the sequence number of the Data Point Record 200. The sequence numbers are assigned by the VIU 32 when the Data Point Record 200 is created.

The numbering of the DPRs 200 (in the SeqNum field 216 of the RecordInfo field 210 of the DPR 200) proceeds as follows: When the VIU 32 is activated (or commissioned), the date and time of the real-time clock of the CPU 26 is used as the 'seed' for the record number. The sequence number always increments by one, unless the VIU 32 is re-commissioned. In that case, the real-time clock is used again to seed the record number. The rate at which records are created on a VIU in-use on a vehicle can never surpass the rate at which the real-time clock (seed as required) increases. This guarantees that sequence numbers will always increase no matter which situation is encountered, although a gap may occur.

Each data item is stored as a Data Point 206 in the Data field 204 of the DPR 200, and is time-stamped. The time stamp of the first data item to be stored in the DPR 200 (the first Data Point 232) is stored in the TimeStart field 218 of the RecordInfo field 210. If the start time is unknown then this field is set to 0 (zero). The TimeOffset field 228 of each DataPoint 206 contains an offset value from the TimeStart field 218.

The TimeStop field 220 contains the time stamp of the last Data Point 234, i.e. the summed values of the TimeStart field 218 and the TimeOffset field 228 of the last Data Point 234, in the Data Point Record 200.

The ConfigSeqNum field 222 contains the sequence number of the configuration information that generated this Data Point Record. The configuration information is a profile controlling the data collection in the vehicle.

The VidDefVersion field 224 contains the version number of the VVI Definitions which the data in this Data Point Record comply with. The abbreviation "VVI" stands for "VRM Value Information", where "VRM" stands for "Vehicle Relationship Management". A VVI definition comprises a list of information types, see VidNumber 226 below.

These last two fields (222 and 224) are mentioned here only for completeness. They are related to software version control, and do not have a direct bearing on the present invention?

The VidNumber field 226 of each Data Point 206 describes what type of data is stored in the EncodedData field 230 of this Data Point. The value of the VidNumber field 226 identifies one information type from list of types provided in the current VVI Definition. The VidNumber field 226 also indirectly provides the length of the EncodedData field 230.

The following Table 1 is an exemplary partial list of VVI definitions for a typical vehicle, showing VidNumbers, their corresponding data types, and their encoded data length in octets.

TABLE 1

| VidNumber | Data Type | Encoded Data Length |
|---|---|---|
| 52 | Calculated Load Value | 1 |
| 53 | Engine Coolant Temperature | 1 |
| 54 | Short Term Fuel Trim - Bank 1 | 2 |
| 55 | Long Term Fuel Trim - Bank 1 | 2 |
| 58 | Fuel Rail Pressure | 1 |
| 59 | Intake Manifold Absolute Pressure | 1 |
| 60 | Engine r.p.m. | 2 |
| 61 | Vehicle Speed Sensor | 1 |
| 62 | Ignition Timing Advance for #1 cylinder | 1 |
| 63 | Intake Air Temperature | 1 |
| 65 | Absolute Throttle Position | 1 |
| 68 | Short Term Fuel Trim | 2 |

The TimeOffset field 228 of the Data Point 206 holds a time offset for this Data Point, that is the difference between the time when this particular Data Point was recorded and the time when the first Data Point 232 of the DPR 200 was recorded. The first Data Point 232 is always of type "Time Stamp" and the TimeOffset field 228 of the first Data Point 232 is always set to zero.

The EncodedData field 230 of the Data Point 206 is an array of up to 24 octets to hold the actual data collected from the vehicle bus 30, or other data such as time stamp data. The number of octets of data stored in this field is determined by the VidNumber field 226, and the by the VVI Version (VidDefVersion field 224) used to encode the DPR 200 that contains this Data Point.

Each DPR 200 can and usually does contain multiple data items (e.g. vehicle speed, engine coolant temperature, etc). Some vehicle information is stored only if the change in the parameter exceeds some delta value (e.g. if the speed of the vehicle changes by more than 2 km/h). This is done to conserve the limited memory resources of the flash memory 27 on the VIU 32. Data Point records are never explicitly deleted from the flash memory 27 on the VIU 32. The flash memory 27 is used like a circular buffer; eventually new data point records will wrap around and overwrite old ones. The flash memory 27 is large enough to hold data (DPRs) collected over several weeks.

Finally, the padding area 208 simply contains the unused octets in the fixed size DPR 200.

A main purpose of the vehicle telemetric system 10 is to reliably and efficiently convey the DPRs from the VIU 32 in the vehicle 18 to the central host 12.

Figure 3:
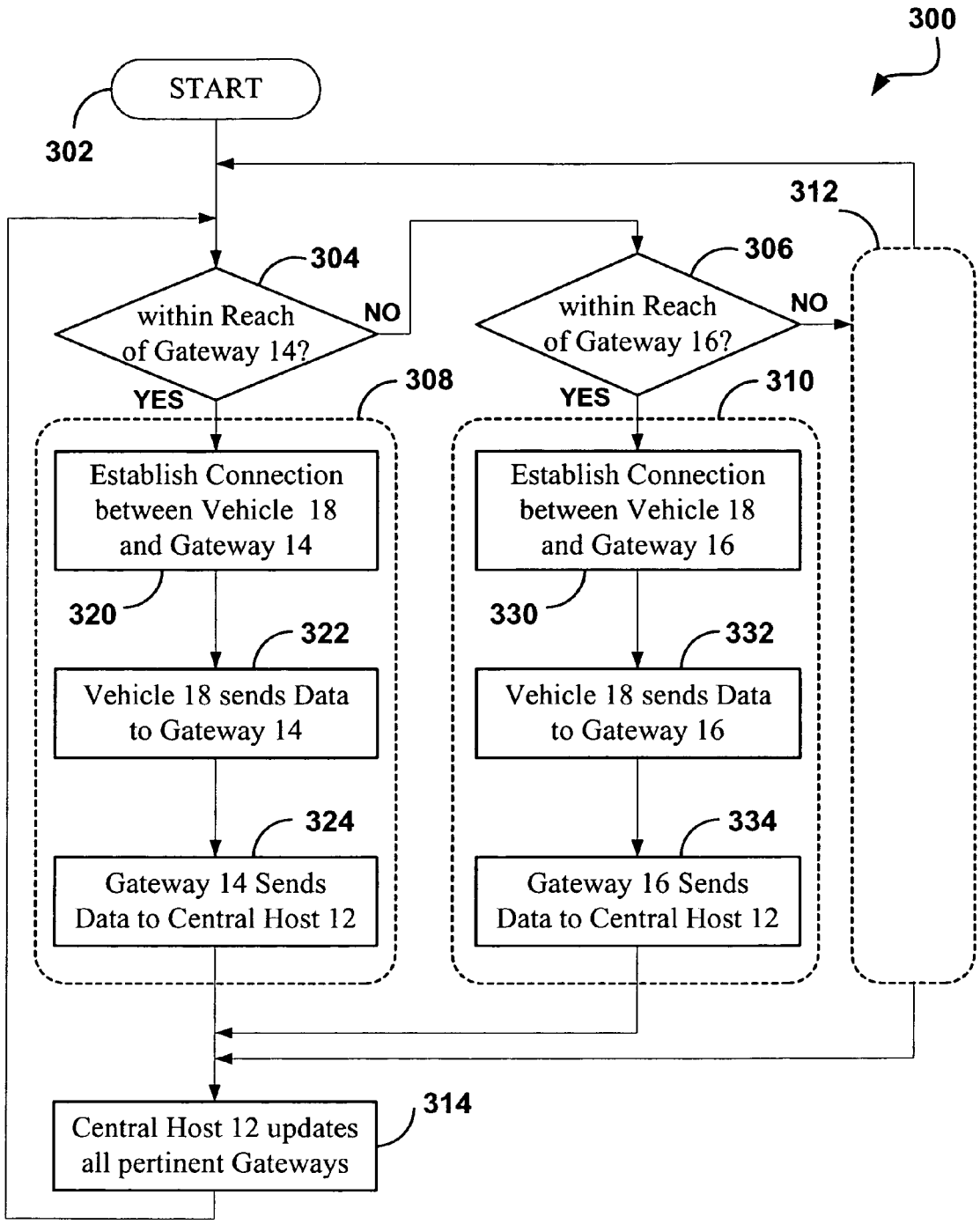
FIG. 3 shows a flow chart 300 of the operation of the vehicle telemetric system 10.

FIG. 3 shows a flow chart 300 of the operation of the vehicle telemetric system 10, comprising a START 302; two decisions 304 and 306; three groupings of steps 308, 310, and 312; and a final step 314.

It should be noted that the description is focused on the events relating to a single vehicle (vehicle 18). The vehicle telemetric system 10 is designed to operate with many vehicles simultaneously. As such the tasks of the computers in the vehicles, the gateways, and the central host are executed concurrently, and may be queued for processing while waiting to be scheduled for processing, as is common in distributed computer systems of the current art.

In other words, the steps of the flow chart 300 describe the logical sequence of the operations related to the conveying of data from a single vehicle (the vehicle 18) to the central host 12. Furthermore, the description is simplified to provide an overview.

The decisions 304 and 306 summarize the condition of the relationship between the VIU 32 and the gateways of the vehicle telemetric system 10 with respect to their ability to communicate wirelessly. Generally, the VIU 32 may be within the wireless range of one gateway, or none. The decisions 304 and 306 may be considered to occur simultaneously and instantaneously.

The decision 304 directs the flow chart to the first grouping of steps 308 if the vehicle 18 is inside the coverage area of the first WLAN 22 (YES exit from the decision 304). If the vehicle 18 is not inside the coverage area of the first WLAN 22 (NO exit from the decision 304), but is within the coverage area of the second WLAN 24 (YES exit from the decision 306), then the flow chart is directed to the second grouping of steps 310. If the vehicle 18 is not inside the coverage areas of neither the first WLAN 22 nor the second WLAN 24 (NO exit from the decision 306), then the flow chart is directed to the third grouping of steps 312.

The first grouping of steps 308 includes steps that are carried out when the vehicle 18 is inside the coverage area of the first WLAN 22, and thus within reach of the first gateway 14, corresponding to the system configuration shown in FIG. 1. The first grouping of steps 308 includes the following steps:

Step 320 "Establish Connection between Vehicle 18 and Gateway 14";

Step 322 "Vehicle 18 sends Data to Gateway 14";

Step 324 "Gateway 14 sends Data to Central Host 12".

In analogous fashion, the second grouping of steps 310 includes steps that are carried out when the vehicle 18 is inside the coverage area of the second WLAN 24, and thus within reach of the second gateway 16. The second grouping of steps 310 includes the following steps:

Step 330 "Establish Connection between Vehicle 18 and Gateway 16";

Step 332 "Vehicle 18 sends Data to Gateway 16";

Step 334 "Gateway 16 sends Data to Central Host 12".

It is noted that the second grouping of steps 310 differs from the first grouping of steps 308 only in the identity of the gateway.

The third grouping of steps 312 includes steps (not shown in detail) that are carried out when the vehicle 18 is inside the coverage area of another WLAN, which is neither the first nor the second WLAN (22 and 24). The third grouping of steps 312 also includes the case when the vehicle 18 is outside the coverage area of any of the WLANs of the vehicle telemetric system 10.

The vehicle telemetric system 10 may comprise additional gateways, in addition to the two gateways 14 and 16. In this case the third grouping of steps 312 includes additional decisions (analogous to the decision 304) and additional groupings of steps (analogous to the groupings 308 and 310), one such grouping for each additional gateway in the vehicle telemetric system 10.

Finally, the flow chart 300 includes the step 314 "Central Host 12 updates selected Gateways". This step follows the steps 324 and 334 in the first and second groupings (308 and 310) respectively. In the case where the vehicle telemetric system 10 comprises additional gateways (lumped together in the third grouping 312), the step 314 also follows the analogous steps (that is analogous to step 324) in the third grouping 312.

In operation, the vehicle 18 moves, from time to time, into and out of the wireless transmission range of any of the gateways of the vehicle telemetric system 10.

After the START 302, the decisions 304 and 306 determine whether the vehicle 18 is within reach of the first gateway 14, the second gateway 16, or neither of these gateways.

When the vehicle 18 moves into the range of the first gateway 14 ("YES" branch of decision 304), the steps 320–324 of the first grouping are executed.

In the step 320 "Establish Connection between Vehicle 18 and Gateway 14", the wireless modem 28 in vehicle 18 is recognized by the WAP 34 in the first gateway 14, thus establishing the WiFi link 40 to enable the transmission of data from the VIU computer 26 in the vehicle 18 to the gateway computer 36 in the gateway 14.

In the step 322 "Vehicle 18 sends Data to Gateway 14", selected data is forwarded from the VIU computer 26 in the vehicle 18, to the gateway storage 38 via the gateway computer 36 in the first gateway 14, over the WiFi link 40.

In the step 324 "Gateway 14 forwards Data to Central Host 12", the selected data is forwarded from the gateway storage 38 through the gateway computer 36 in the first gateway 14, to the central host 12, over the central connection 42.

Following the step 324, in the step 314 "Central Host 12 updates all pertinent Gateways", the gateway computer 36 in the first gateway 14, as well as the gateway computers in all pertinent other gateways of the vehicle telemetric system 10 are updated by messages from the central host 12, transmitted over the WAN 20.

The words "selected" and "pertinent" were used in the description of the steps 320–324. This will be clarified now.

The vehicle telemetric system 10 is capable of serving a large number of vehicles and may contain a large number of gateways. The vehicles may be grouped into fleets according to owners, or other criteria. The gateways may be distributed over a large territory, and not every gateway is necessarily enabled to serve every vehicle or vehicle fleet. Thus, a "pertinent" gateway with respect to a specific vehicle (vehicle 18 in the example) is a gateway that is enabled to serve the specific vehicle.

The VIU in a vehicle (e.g. the VIU 32 in the vehicle 18), whether within wireless transmission range of a gateway or not, is programmed to periodically collect vehicle data in the form of data point records (DPR) 200.

Thus a VIU, while it is not within range of a (pertinent) gateway, stores the collected DPRs in its on-board computer. Once a vehicle enters the range of a pertinent gateway and has established communication with it (step 320), the VIU in the vehicle transmits "selected" data in the form of DPRs to the gateway, where "selected" means only those DPRs which are not known to have already been received by the central host 12.

Once the selected DPRs are forwarded by the gateway to the central host, the central host updates all pertinent gateways. Thus all (pertinent) gateways are given information that indicates which DPRs from the specific VIU (i.e. vehicle) have already been received by the central host.

Further Details of the Operation of the Vehicle Telemetric System

Figure 4:
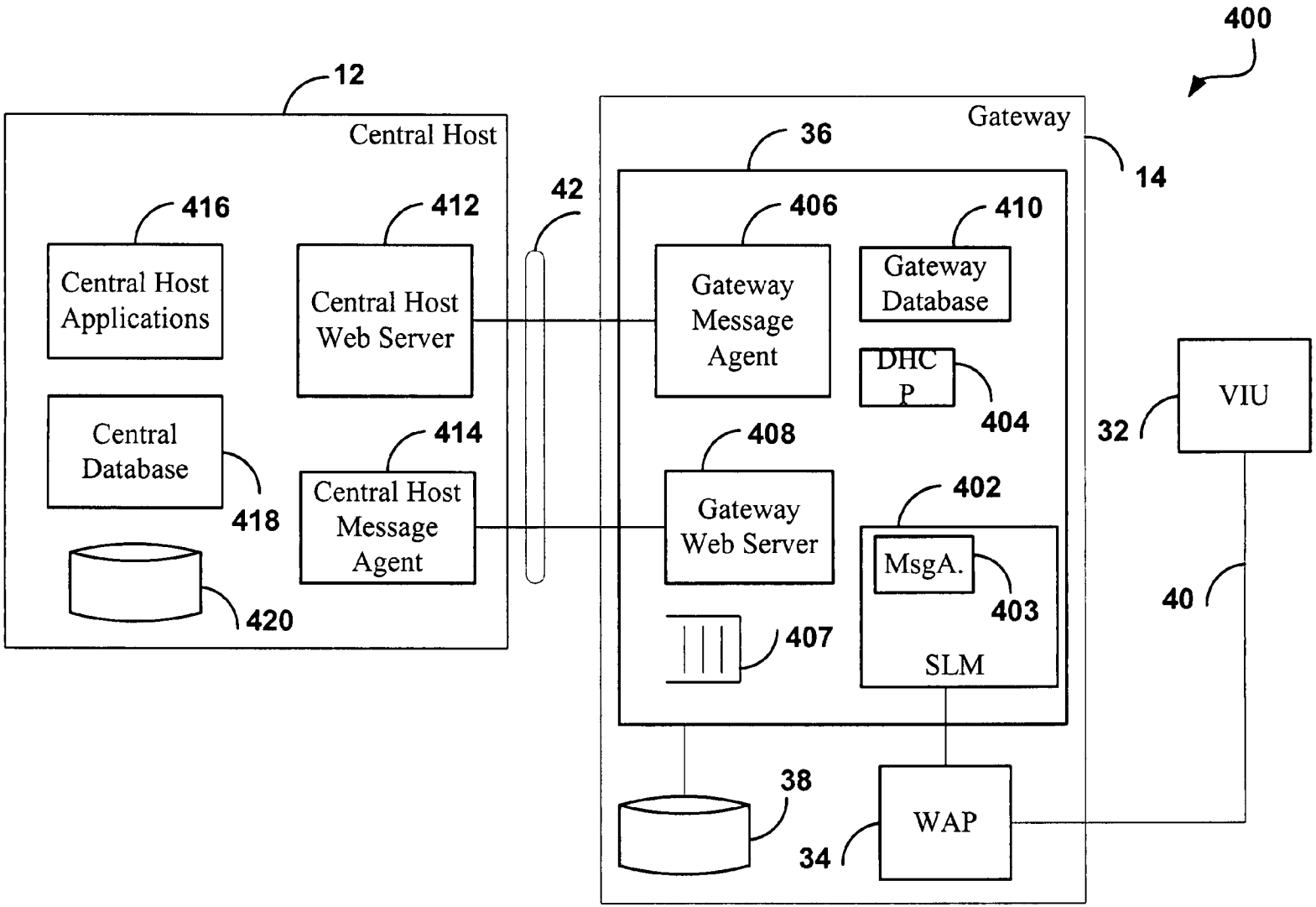
FIG. 4 shows a subset 400 of the vehicle telemetric system 10.

FIG. 4 shows a subset 400 of the vehicle telemetric system 10, including the central host 12, the single gateway 14, and the VIU 32. Illustrated in FIG. 4 are further; components of the central host 12; components of the gateway 14, that is the wireless access point (WAP) 34, the gateway computer 36, and the gateway storage 38; and components of the gateway computer 36.

The gateway computer 36 is expanded to show major components, namely a "Southward Looking Module" (SLM) 402 comprising an SLM Message Agent 403; a Dynamic Host Configuration Protocol (DHCP) server 404; a Gateway Message Agent 406; a processing queue 407; a Gateway Web Server 408; and a Gateway Database 410. The Gateway Database may for example be implemented using a commercial database product such as the Access Database product from Microsoft Corporation.

The central host 12 is expanded to show major components, namely a Central Host Web Server 412; a Central Host Message Agent 414; a Central Host Applications 416; an Central Database 418; and a central storage 420. The central storage 420 is preferably implemented as permanent storage on a hard disk. The Central Database 418 is preferably implemented as a Relational DataBase Management System (RDBMS), for example an Oracle Database.

Figure 5:
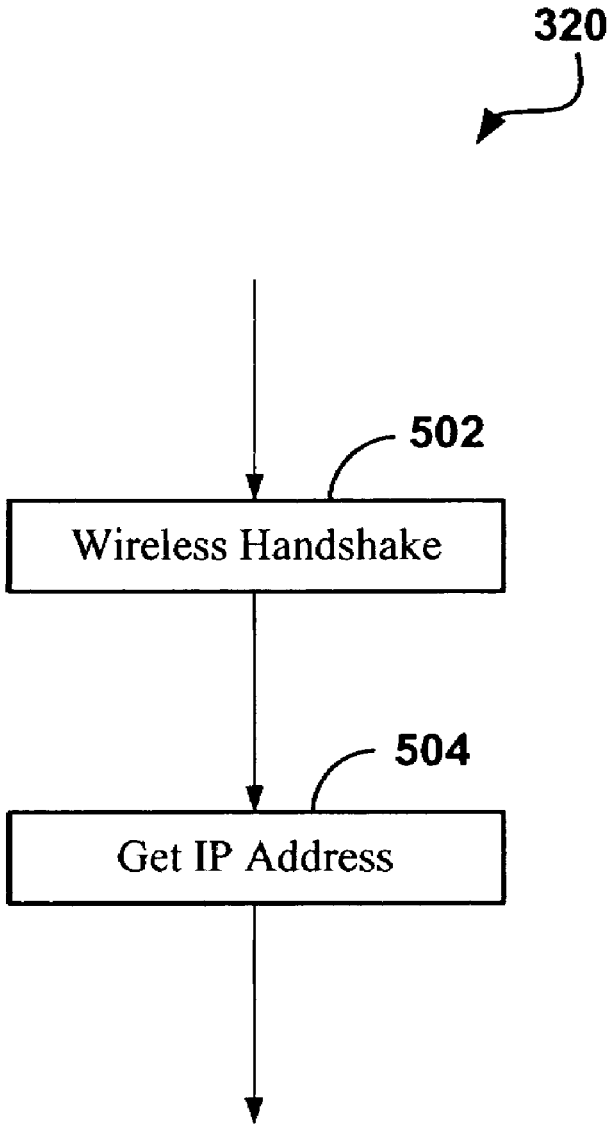
FIG. 5 is a more detailed description of the step 320 of the flow chart 300.

FIG. 5 is a more detailed description of the step 320 of the flow chart 300, referencing the components shown in the subset 400 of the vehicle telemetric system 10 shown in FIG. 4, including steps designed to ensure efficient and reliable communication, in accordance with the preferred embodiment.

As shown in FIG. 5, the step 320 (FIG. 3) comprises a step 502 "Wireless Handshake", and a step 504 "Get IP Address".

Step 502 "Wireless Handshake"

A wireless handshake takes place over the WiFi link 40, between the VIU 32 (in the vehicle 18) and the WAP 34 (in the gateway 14) according to the standard IEEE 802.11b protocols.

When coming within reach of the WAP 34, the VIU 32 confirms the validity of the WAP 34 to establish 802.11b connectivity over the WiFi link 40. The VIU—WAP connection is dependent upon both units having the same SSID (Service Set Identifier) and WEP (Wired Equivalent Privacy) keys. These keys are defined in the 802.11b communication protocol. The channel of communication of the WAP (i.e. channel 1 through 11) is determined by the user, as a configuration item. The VIU will automatically scan channels 1 through 11 in order to find the appropriate WAP, which is configured with the correct WEP and SSID. The VIU 32 transmits the WEP and SSID keys to the WAP 34, however, it is the WAP 34 that decides if it will permit the VIU 32 to communicate with the gateway CPU 36.

Step 504 "Get IP Address"

Once (and if) WiFi connectivity achieved in the step 502, the VIU 32 obtains a local Internet Protocol (IP) address in a standard fashion from the DHCP server 406 that runs in the gateway CPU 36. This local IP address is only valid on the subnet which is the WLAN 22, and which includes the VIU 32 and the gateway 14 (see FIG. 1). In the preferred embodiment, the DHCP server 406 provides the DHCP functionality. Alternative embodiments may use a DHCP server located in the WAP 34 or elsewhere in the vehicle telemetric system 10, or statically provision an IP address for the VIU 32. However, the use of static IP addressing (manually assigned), is not preferred because it would place a restriction on the number of vehicles (VIUs) that can be active in the vehicle telemetric system 10.

Figure 6:
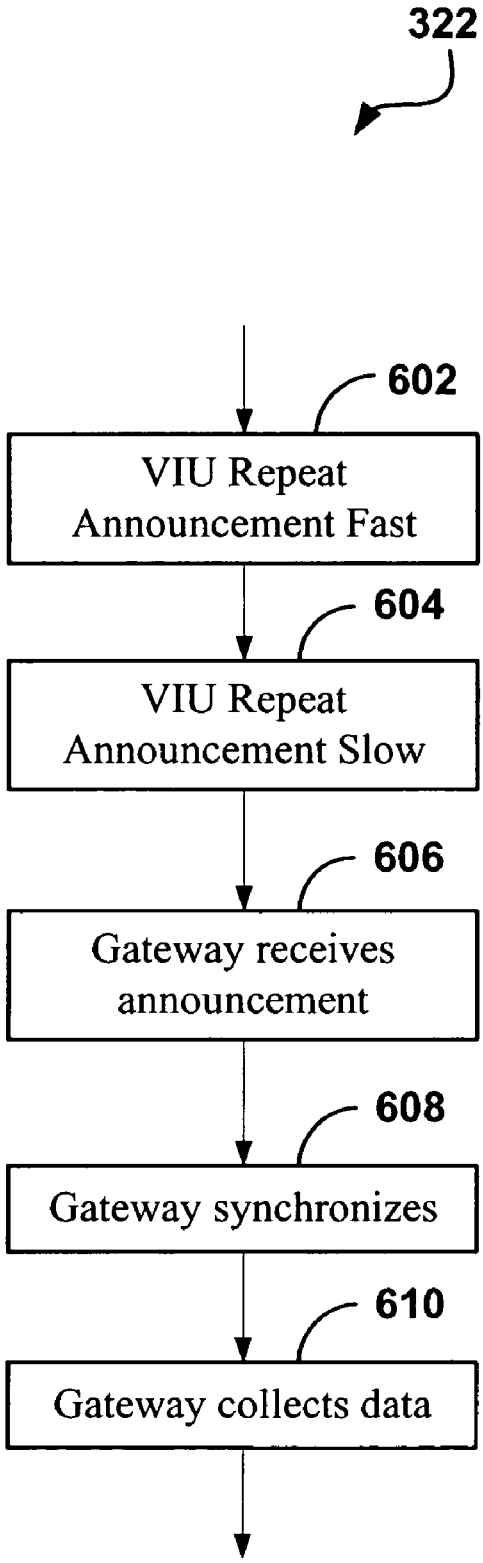
FIG. 6 is a more detailed description of the step 322 of the flow chart 300.

FIG. 6 is a more detailed description of the step 322 of the flow chart 300, again referencing the components shown in the subset 400 of the vehicle telemetric system 10 shown in FIG. 4, and including steps designed to ensure efficient and reliable communication, in accordance with the preferred embodiment.

As shown in FIG. 6, the step 322 (FIG. 3) comprises a step 602 "VIU Repeat Announcement Fast"; a step 604 "VIU Repeat Announcement Slow"; a step 606 "Gateway receives announcement"; a step 608 "gateway synchronizes"; and a step 610 "gateway collects data".

Figure 7:
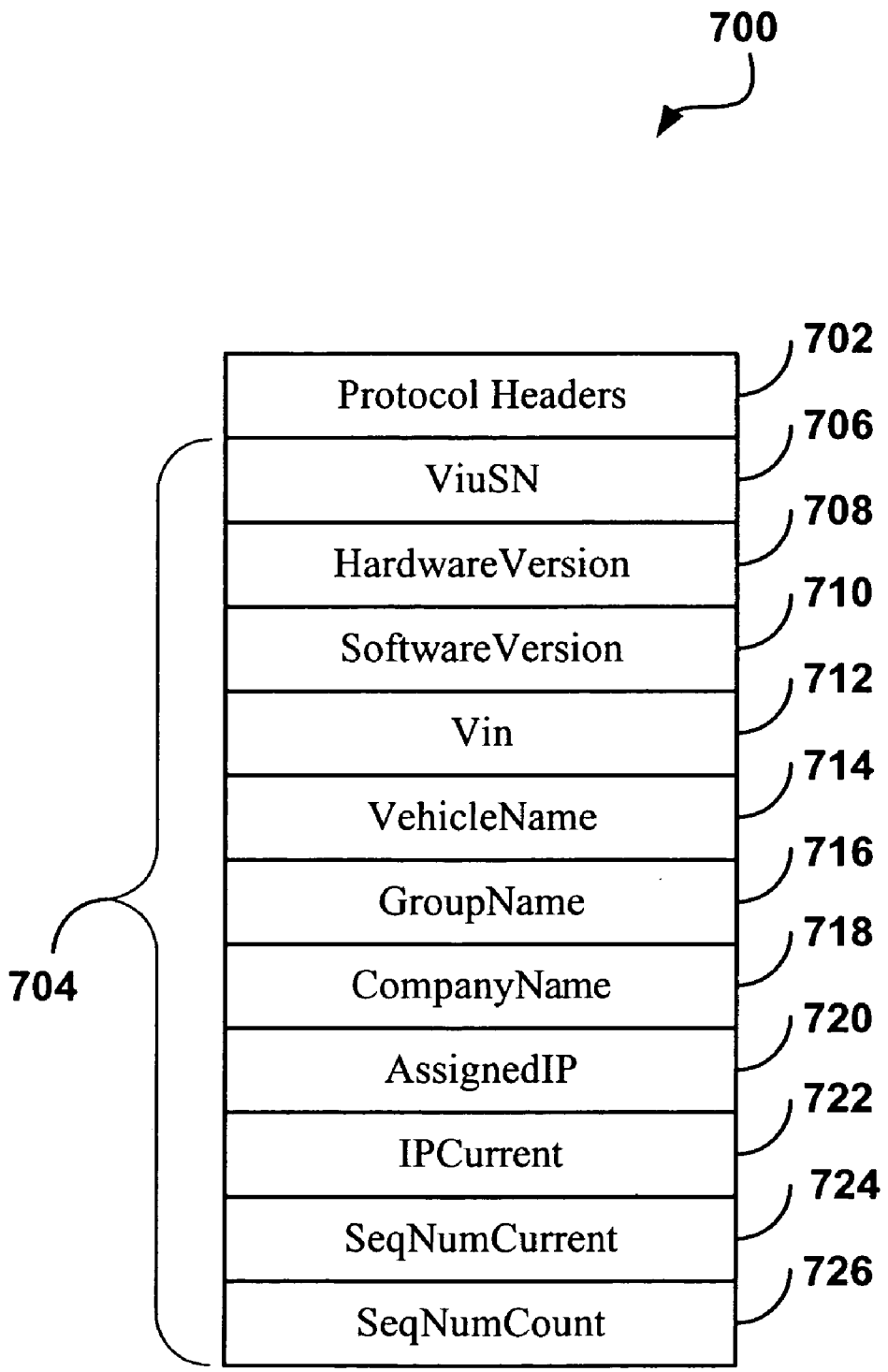
FIG. 7 shows the format of a VIU Announce Packet 700 of the vehicle telemetric system 10.

The steps 602 and 604 are based on an announcement packet (a VIU Announce Packet 700), the format of which is illustrated in FIG. 7.

The "VIU Announce Packet" 700 includes a protocol headers field 702, and a VIUInformation record 704. The protocol headers field 702 includes standard protocol headers for 802.11b and IP. The VIUInformation record 704 includes the following fields:

Step 602 "VIU Repeat Announcement Fast"

In the step 602 "VIU Repeat Announcement Fast", the VIU 32 transmits, using the standard IP multicast with an address selected in the range of 239.255.0.0 to 239.255.255.255, the VIU Announce Packet 700 twenty times rapidly, that is at the rate of one VIU Announce Packet 700 per second.

Step 604 "VIU Repeat Announcement Slow"

After a period of 20 seconds (this period of the step 602 "VIU Repeat Announcement Fast" is also referred to as the Fast-Announce-Interval or FAI) has elapsed, and assuming that the VIU 32 is still in range of the WAP 34, the step 604 is performed. In the step 604 "VIU Repeat Announcement Slow", the VIU 32 continues to transmit the VIU Announce Packet 700 more slowly, at the rate of one VIU Announce Packet 700 every 10 seconds.

The period of the step 604 "VIU Repeat Announcement Slow" is also referred to as the 'Slow Announce Interval' (SAI). The SAI is required to prevent wireless network traffic congestion in the WAP 34, in a scenario when many vehicles are within range, for example in a large parking lot. In effect, communication priority is given to the vehicles that have just arrived in range of the WAP 34 and are trying to initiate communication.

The repeated transmission of VIU Announce Packets 700 (steps 602 and 604) continues as long as the valid 802.11b connectivity over the WiFi link 40 and the WAP 34 exists. The VIU 32 thus continues to try to announce itself to the SLM 402 (which runs on the CPU 36 of the gateway 14) until the gateway 14 receives the announcement (step 606) and synchronizes (step 608).

The VIU (32)-to-SLM (402) communication is via a stateless communication mechanism. The VIU 32 has no knowledge of what information the SLM 402 or the Central Host 12 has locally. During the steps 602 and 604 ("VIU Repeat Announcement Fast" and "VIU Repeat Announcement Slow" respectively), data is being continuously gathered from the vehicle 18 and stored in the flash memory 27 of the CPU 26 of the VIU 32, at a rate commensurate with the condition of the vehicle, typically one Data Point Record 200 every 3 to 7 minutes when the engine of the vehicle is running, and a Data Point Record 200 every few hours when the engine is turned off. The content of the VIU Announce Packet 700 (reflecting the sequence number of the most

| | |
|---|---|
| 706 "ViuSN": | the serial number of the VIU for which the data in this structure applies to. |
| 708 "HardwareVersion": | a string describing the version of the VIU hardware. |
| 710 "SoftwareVersion": | a string describing the current version of the VIU software (or firmware). |
| 712 "Vin": | the VIN number of the vehicle. This field is filled in if the VIU is able to read the VIN directly from the vehicle. |
| 714 "VehicleName": | the assigned name of the vehicle on which this VIU is installed. This field may be empty. |
| 716 "GroupName": | the name of the group that the node belongs to. This field may be empty. |
| 718 "CompanyName": | the name of the company that this node belongs to. This field may be empty. |
| 720 "AssignedIP": | if the VIU has been assigned a specific IP number, this field should be set to "TRUE". Otherwise the VIU obtains its IP number from DHCP (see step 504) and this field is set to "FALSE". |
| 722 "IPCurrent": | the current IP number of the node. |
| 724 "SeqNumCurrent": | the record sequence number of the most current record (DPR) stored by the VIU. |
| 726 "SeqNumCount": | the number of records currently stored by the VIU. |

current record in the "SeqNumCurrent" field 724) may remain unchanged over the duration of the FAI. But its content can also vary, if the number of data point records stored within the VIU increases in the time interval between announcements.

Step 606 "Gateway Receives Announcement"

The step 606 "Gateway receives announcement" may occur during the FAI (step 602) or the SAI (step 604), when the SLM 402 of the gateway 14 successfully receives a VIU Announce Packet 700, via the WiFi 802.11b link 40 and the WAP 34.

Step 608 "Gateway Synchronizes"

In the next step (step 608 "gateway synchronizes"), the SLM 402 examines the received VIU Announce Packet 700 to determine if it should communicate (synchronize) with the VIU 32. If the VIU Announce Packet 700 is "uninteresting", the SLM 402 ignores it, and nothing further happens at the SLM 402 although the VIU 32 continues to send VIU Announce Packets 700. The SLM 402 will synchronize with the VIU 32 if it implicitly knows about the VIU 32, that is if the VIU serial number (ViuSN field 706 of the received VIU Announce Packet 700) is recognized to belong to a given company 'A', and is not an unidentified serial number belonging to company 'B' or 'C', and if it can determine that data needs to be uploaded from the VIU 32.

As mentioned earlier, a purpose of the vehicle telemetric system 10 is to reliably and efficiently convey the DPRs 200 (containing the data collected from the vehicle 18) from the VIU 32 in the vehicle 18 to the central host 12. The efficiency of this operation is enhanced if each DPR 200 is not unnecessarily transmitted more than once, while reliability is enhanced if each DPR 200 is transmitted at least once. If, on occasion, duplicate DPRs are received in the central host 12 (duplicates are identifiable through the RecordInfo field 210 of the DPR) they are easily discarded.

The SLM 402 internally maintains a list of the sequence numbers of Data Point Records 200 that have been uploaded to it from each individual VIU. The SLM 32 can thus compare its internal data with the information supplied in the IP multicast VIU Announce Packet 700 (that is the "SeqNumCurrent" 724 and the "SeqNumCount" 726) to determine if the VIU has new data to upload.

If the VIU 32 has no new data, then the SLM 402 will not attempt to communicate (synchronize) with the VIU (reducing WiFi traffic and conserving bandwidth).

If the SLM 402 determines that the VIU 32 does have new data, then the SLM 402 adds the VIU's serial number (from the ViuSN field 706 of the VIU Announce Packet 700) to the processing queue 407 in the gateway computer 36.

In either case (whether or not the VIU 32 has new data), the VIU 32 continues to send "VIU Announce Packets" 700 which may indicate that new information is available, even after the first VIU Announce Packet 700 was received by the SLM 402 (start of the step 606). In this way, the availability of new information from the VIU 32 can be recognized by the SLM 402 as long as the WiFi 802.11b link 40 between the VIU 32 and the SLM 402 is working.

Since it is possible that more than one vehicle having a VIU is within the range of the single gateway 14, message collection in the SLM Message Agent 403 of the gateway computer 36 is multitasked, enabling multiple VIUs to be serviced simultaneously.

Step 610 "Gateway Collects Data"

In step 610 "gateway collects data" (FIG. 6), the SLM Message Agent 403 (FIG. 4) extracts the VIU's serial number from the processing queue 407.

The SLM Message Agent 403 then services the VIU 32, using the standard HyperText Transfer Protocol (HTTP) to request and upload 'new' DPRs 200 from the VIU 32 to the SLM 402. The SLM 402 uploads the DPRs 200 from the VIU 32 in the binary data format described in FIG. 2.

In order to maximize the amount of data that can be uploaded wirelessly from the VIU 32 to the Gateway 14 (through the SLM 402), using an unpredictable or short duration wireless connection, the following methodology was devised. In the limiting case for a short-duration WiFi connection (connection 40), only a single frame of data would be transmitted successfully across the wireless link. If the basic 'packet' of data, the DPR 200, was spread over several 802.11b transmission frames, the receiving end (i.e. the SLM 402 in the Gateway 14) would then be unable to reassemble the DPR, since only one frame of data was received. The entire DPR 200 would have to be retransmitted when the link was re-established. In order to achieve maximum throughput under poor or intermittent WiFi link conditions, the DPR was chosen in size to fit within a single 802.11b data transmission frame. Thus even if only a single WiFi data frame (containing a DPR 200) was successfully received by the SLM 402, it will contain an entire data entity, i.e. the DPR 200, which contains a complete encapsulated set of data points 206 from the VIU 32. All communication messages (i.e. the "VIU Announce Packet" 700, and DPRs 200) taking place between the VIU 32 and the Gateway 14, have been defined to fit within one wireless 802.11b transmission frame.

The SLM 402 keeps the received DPRs 200 on local storage (the gateway storage 38) until instructed by the Central Host 12 (via the gateway message agent) to delete them, see the further description of the step 314 below.

Using the information from the "VIU Announce Packet" 700, the SLM Message Agent 403 identifies new records (DPRs) that are available in the VIU 32, and using the standard HTTP protocol, collects these from the VIU 32 (SLM 402 sends an HTTP "Get" message, the VIU 32 sends data in the form of DPRs 200). The SLM 402 stores the new DPRs 200 on the gateway storage 38. Note: the gateway storage 38 is expected to "always" have space, since old records are deleted (see step 314).

The SLM 402 notifies the gateway web server application 408 that new VIU data records are available. This notification is performed indirectly using an HTTP "Get" message to pro-form a request a pre-defined web page. The VIU's serial number is supplied to the request as a parameter.

The gateway web server determines if the notification request is related to an active VIU that will need servicing. The last notification for each VIU is stored in the Gateway Database 410 on the gateway computer 36, regardless of whether the VIU should be serviced or not. This Gateway Database contains a log of all VIUs that have tried to talk to the gateway 14. It also contains data about all VIUs that it should know about, including status information such as if the VIU been activated (commissioned) for use in a vehicle.

The Gateway Database 410 also maintains a state field regarding all VIUs that have been assigned (by the Central Host 12) to this gateway 14. If the state field indicates "activeVIU=TRUE" for the given VIU 32, this allows the gateway 14 to determine whether the newly collected data from the VIU 32 are of interest to the Central Host 12. If the field indicates "activeVIU=FALSE" then the data is still held in the gateway storage 38, until such time, possibly later, when the Central Host 12 informs the gateway 14 that the given VIU 32 is now active.

Figure 8:
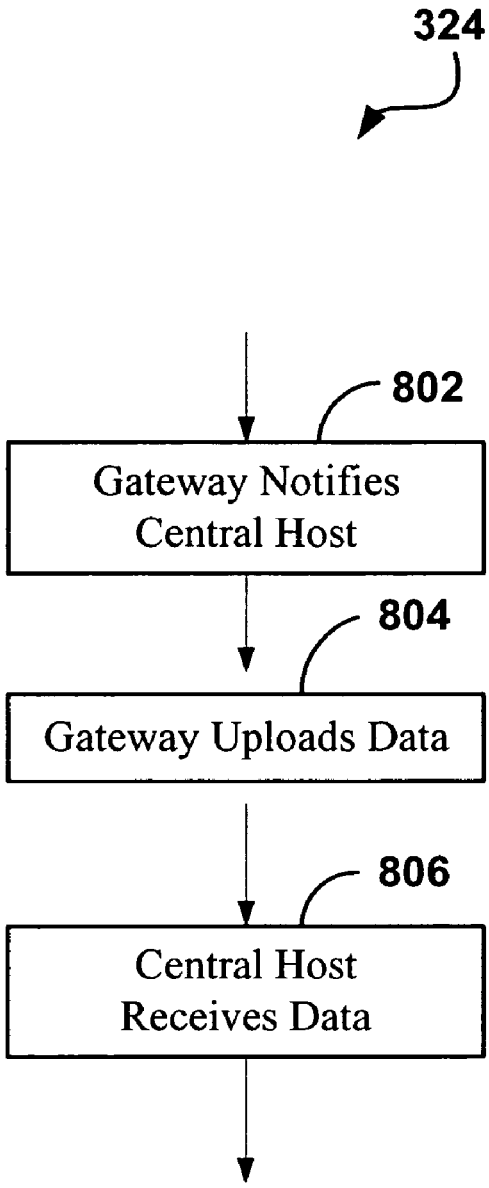
FIG. 8 is a more detailed description of the step 324 of the flow chart 300.

FIG. 8 is a more detailed description of the step 324 "Gateway 14 sends Data to Central Host 12" of the flow chart 300, again referencing the components shown in the subset 400 of the vehicle telemetric system 10 shown in FIG. 4, including steps designed to ensure efficient and reliable communication, in accordance with the preferred embodiment.

As shown in FIG. 8, the step 324 (FIG. 3) comprises a step 802 "Gateway Notifies Central Host"; a step 804 "Gateway Uploads Data"; a step 806 "Central Host Receives Data"

Step 802 "Gateway Notifies Central Host"

In step 802, the gateway 14 (through the Gateway Message Agent 404) sends a registration request to the Central Host 12 (specifically the Central Host Web Server 412) using a service of the standard eXtensible Markup Language (XML) over HTTP, indicating that the given VIU 32 has data available for transfer. The Central Host 12 verifies the registration request (i.e. checks to see if it needs data from the VIU 32) and (through the Central Host Message Agent 414) requests the Gateway Web Server 408 in the gateway CPU 36 to upload all required data that it doesn't already have (i.e. new DPRs 200).

Step 804 "Gateway Uploads Data"

In step 804, the Gateway Web Server 408 requests the specified DPRs 200 from the SLM 402. The SLM 402 retrieves the specified DPRs 200 from the gateway storage 38, and converts the binary data into an equivalent American Standard Code for Information Interchange (ASCII) data string, to facilitate insertion into an XML document. The ASCII data string is required because ASCII is the reference character set for XML content. The Gateway Web Server application 408 is based upon standard XML web services.

Step 806 "Central Host Receives Data"

In step 806, after receiving the registration request from the gateway 14 (step 802 above), the Central Host 12 receives the uploaded data (i.e. the new DPRs 200, see step 802 above). The DPRs uploaded to the Central Host 12 are stored in the Central Storage 420 under control of the Central Database.

The Central Host 12 keeps track of all DPRs uploaded, and all DPRs can be traced back to the originating VIU and the Gateway from which they were uploaded. In the event that a duplicate DPR is detected, it is discarded.

Further Description of the Step 314 "Central Host 12 Updates Selected Gateways"

After receiving uploaded DPRs from the gateway 14, the Central Host Message Agent 414 in the Central Host 12 sends a request (using the standard XML web services) to the Gateway Web Server 408 in the Gateway 14 to discard the uploaded DPRs. The Gateway Web Server 408 then passes this request to the SLM 402 to delete the DPRs from the gateway storage 38.

If additional Gateways (such as the second gateway 16 in FIG. 1) are part of the vehicle telemetric system 10, the Central Host 12 also informs all these other Gateways (via XML) that it has received specific DPRs from the given VIU 32. This synchronizes the information on each of the Gateways, so that the SLMs of these gateways will not request and upload DPRs from the given VIU 32, should the vehicle later come within the range of these other gateways. This avoids unnecessarily uploading DPRs that have already been transferred from the VIU 32 to the Central Host 12.

Continuity of Information Flow Across Two Gateways

The Central Database 418 of the Central Host 12 (the RDBMS), holds a number of tables that are used in the operation of the vehicle telemetric system 10, the table data being stored on the central storage 420. Similarly, the Access Data Base 410 of the gateway 14 (and similarly every other gateway of the vehicle telemetric system 10 holds a number of tables, the table data being stored on the respective gateway storage 38. Information in these tables is used to ensure that all DPRs 200 generated in each VIU reach the Central Host 12, regardless of which Gateway (14, or other gateway of the telemetric system 10) is used to forward the DPRs from the VIU to the Central Host 12.

Two tables in the Central Host 12 are the following:

- a Central VIUS Table 902, the record format of which is shown in FIG. 9*a*; and
- a Central Registry Table 904, the record format of which is shown in FIG. 9*b*.

The diagrams of FIGS. 9*a* and 9*b* in each case illustrate the format of a single record, all fields being shown with their descriptive titles. Several fields contain information commonly used for the management of the data bases (e.g. indices such as "Record Id"), system management information (e.g. "Time Stamp"), or information of importance to other applications which may be running on the Central Host 12.

Figure 9D:
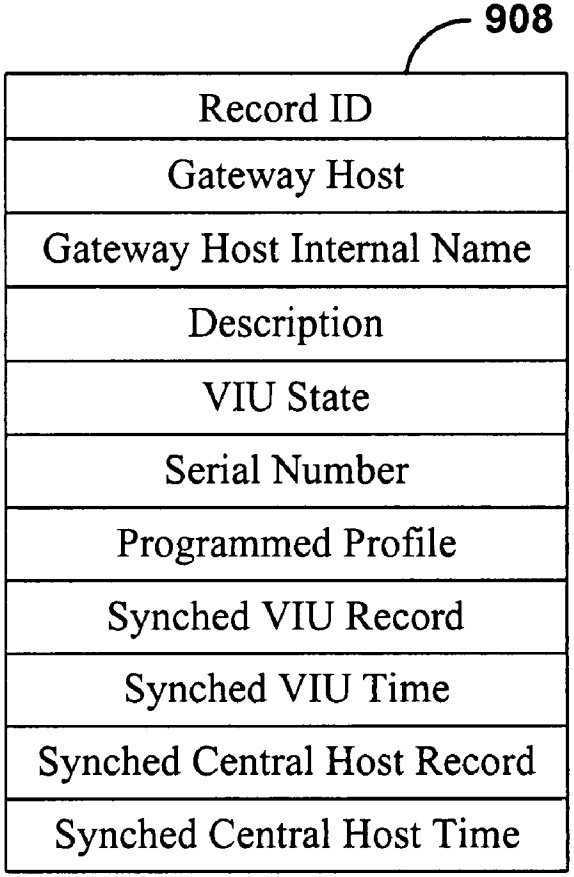
FIG. 9*d* shows the record format of a Gateway VIUS Table 908 of the vehicle telemetric system 10.
Figure 9C:
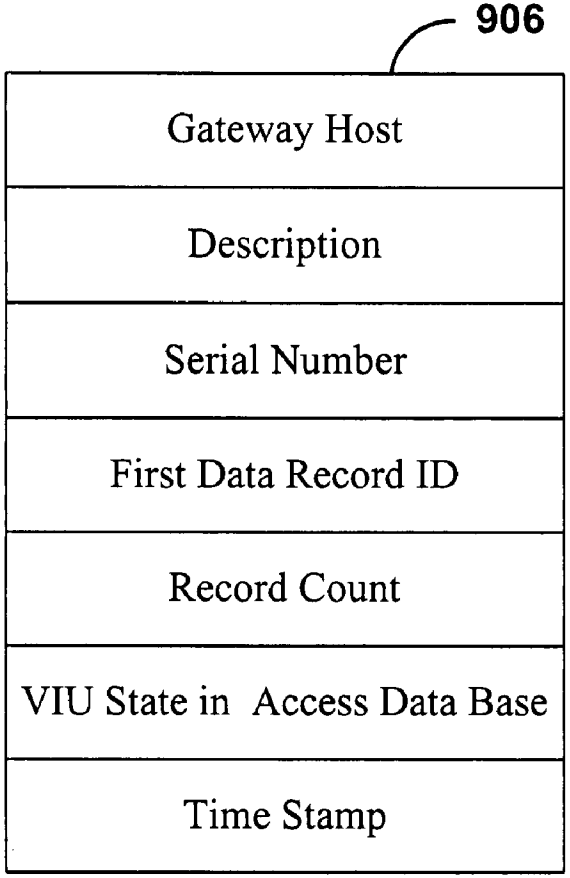
FIG. 9*c* shows the record format of a Gateway ViuInfo Table 906 of the vehicle telemetric system 10.

Two tables in the Gateway 14 are the following:

- a Gateway ViuInfo Table 906, the record format of which is shown in FIG. 9*c*; and
- a Gateway VIUS Table 908, the record format of which is shown in FIG. 9*d*.

It is understood that the description of the Gateway tables not only applies to the Gateway 14 but also to all other gateways of the telemetric system 10.

A further table, a DPR table (not shown) in the Central Host 12 contains all Data Point Records (DPRs) that are received from each VIU in the vehicle telemetric system 10. The DPR table is a history of DPRs by VIU, for further processing outside the scope of the present invention.

Initialization

When the telemetric system 10 is set up to accommodate a specific VIU (e.g. the VIU 32), the particulars of the VIU (i.e. Serial Number, VIU Type, Programmed Profile) and of the vehicle the VIU is installed in (i.e. VIN, license), are entered in the Central VIUS Table 902 of the Central Database 418 of the Central Host 12. The other Fields of the Central VIUS Table 902 are set to defaults.

The Central Registry Table 904 is initially empty, and an entry (a record) is dynamically created each time a gateway reports a VIU.

A record in the Gateway VIUS Table 908 of every "pertinent" gateway (a gateway that is enabled to serve a specific VIU, see above) is initialized for every VIU in the telemetric system 10, with the Serial Number of the VIU, and default information in the other fields.

The Gateway ViuInfo Table 906 is initially empty, and an entry (a record) is dynamically created when a VIU announces itself to the gateway (see "VIU Announce Packet" 700 above), provided the VIU is recognized or not in the Gateway (has an entry in the Gateway VIUS Table 908).

Use Case

Figure 10:
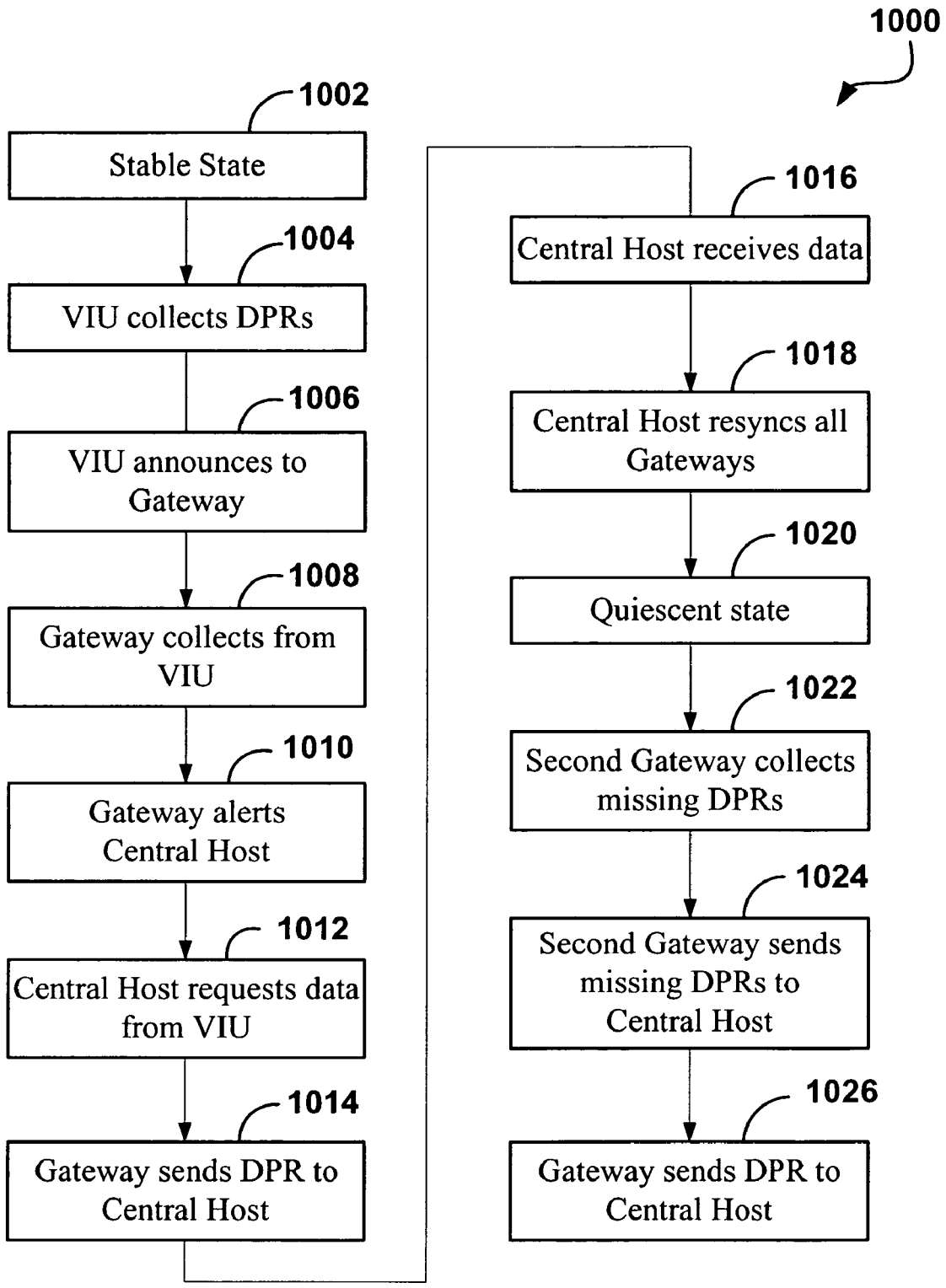
FIG. 10 illustrates the steps of a Use Case 1000 of the vehicle telemetric system 10.

To further illustrate the invention, from another aspect, a Use Case 1000 is shown in FIG. 10.

In the use case 1000, it is assumed that the telemetric system 10 has been set up and is running already. The VIU 32 comes within range of the gateway 14, announces itself and transfers a number of records. The gateway 14 transfers these records to the central host 12. Subsequently, the VIU 32 loses communication with the first gateway 14, and communication with a second gateway (the second gateway 16) is achieved a short time later.

The steps of the use case 1000 are:

a step 1002 "Stable State";

a step 1004 "VIU collects DPRs";

a step 1006 "VIU announces to Gateway";

a step 1008 "Gateway collects from VIU";

a step 1010 "Gateway alerts Central Host";

a step 1012 "Central Host requests data from VIU";

a step 1014 "Gateway sends DPR to Central Host";

a step 1016 "Central Host receives data";

a step 1018 "Central Host resyncs all Gateways";

a step 1020 "Quiescent state";

a step 1022 "Second Gateway collects missing DPRs";

a step 1024 "Second Gateway sends missing DPRs to Central Host"; and a step 1026 "Central Host Resyncs all Gateways again".

The contents of a number of fields in the Central Host and Gateway tables are affected, and track the progress of the gathering of data from the VIU 32, and transfer of the data to the central host 12. The affected fields are located in the database records that are specific to the given VIU 32:

in the Central VIUS Table 902, the field "Last Data Record Transferred";

in the Central Registry Table 904, the fields "Record ID", "Data Ready Rec ID", "Data Ready Rec Count", "Complete Rec ID", "Complete Rec Count", and "Entry State";

in the Gateway ViuInfo Table 906, the fields "First Data Record ID" and "Record Count"; and in the Gateway VIUS Table 908, the fields "Synched VIU Record" and "Synched Central Host Record";

The time and time stamp fields also change according to the time of the events. The tracking of time and time stamps is not essential to the normal operation of data gathering, but is useful for diagnostics in abnormal situations, as well as for statistical and other purposes. The steps of the example use case 1000 correspond to the steps 308 and 314 and their sub steps above, but are described in a different aspect here to illustrate the efficiency and continuity of the information flow that is achieved through the use of the VIU-specific tables 902–908 when communication with the VIU in the vehicle is interrupted and subsequently regained.

Step 1002 "Stable State"

"Stable State" is an assumed initial state where the Central Host 12 has received DPRs, up to the DPR #3000 (a DPR 200, with the SeqNum field 216 containing the number 3000), where there are no outstanding DPRs, and where there is no recent Gateway activity. All Gateways are stable and updated, i.e. there are no pending DPRs or updates.

| | |
|---|---|
| Gateway(16) ViuInfo Table 906, "First Data Record Id" = | 3000 |
| Gateway(16) ViuInfo Table 906, "Record Count" = | 1 |
| Gateway(14) ViuInfo Table 906, "First Data Record Id" = | 2990 |
| Gateway(14) ViuInfo Table 906, "Record Count" = | 10 |

The Gateway ViuInfo Table 906 table keeps track of the last attempt by the VIU to notify the Gateway (see step 608 above). This information stays unchanged until the next notification.

| | |
|---|---|
| Gateway(16) VIUS Table 908, "Synched VIU Record" = | 3000 |
| Gateway(16) VIUS Table 908, "Synched Central Host Record" = | 3000 |
| Gateway(14) VIUS Table 908, "Synched VIU Record" = | 2999 |
| Gateway(14) VIUS Table 908, "Synched Central Host Record" = | 3000 |
| Central Host VIUS Table 902, "Last Data Record Transferred" = | 3000 |
| Central Host Registry Table 904, "Record ID" = | 1001 |
| Central Host Registry Table 904, "Data Ready Rec ID" = | 3000 |
| Central Host Registry Table 904, "Data Ready Rec Count" = | 1 |
| Central Host Registry Table 904, "Completed Rec ID" = | 3000 |
| Central Host Registry Table 904, "Completed Rec Count" = | 1 |
| Central Host Registry Table 904, "Entry State" = | Complete |

The use case will follow the steps occurring when the vehicle (VIU 32) comes within the range of the first gateway 14. However, it is assumed that the vehicle was previously at the second Gateway 16 (see FIG. 1), and the DPR #3000 had been received by the second gateway 16.

Step 1004 "VIU Collects DPRs"

In the step 1004 the VIU 32 collects DPRs (from vehicle data) with sequence numbers 3001, 3002, 3003, 3004.

There are no state changes at the Gateway or the Central Host yet.

Step 1006 "VIU Announces to Gateway"

The step 1006 "VIU announces to Gateway" corresponds to the steps 602 to 606 above.

In the step 1006 the VIU 32 sends a VIU Announce Packet 700 to the first gateway 14, with the contents of the SeqNumCurrent field 724 set to "3004" and the SeqNumCount field 726 set to "4".

Step 1008 "Gateway Collects from VIU"

In the step 1008, the gateway collects DPRs from the VIU, starting with the most recent DPR. In this example, the wireless connection is disrupted after the first (most recent) DPR has been received. The gateway recognizes that the VIU had uploaded one record (#3004). The gateway ViuInfo table 906 is updated to reflect that a first set of DPRs is retrieved (one in this case), the first DPR in the set being DPR #3004 and the record count being a count of 1. The first gateway 14 will realize that previously collected data had no gaps. It will notice however that disk storage had received only one record not four as expected. Later on it will try to collect those missing records after the high priority latest records. From then on it will primarily rely on disk store for missing records rather than ViuInfo transient entry. It will eventually bring ViuInfo back to being in synch, when data is collected by this gateway.

The Gateway VIUS Table 908 is unchanged.

| | |
|---|---|
| Gateway(14) ViuInfo Table 906 "First Data Record Id" = | 3004 |
| Gateway(14) ViuInfo Table 906 "Record Count" = | 1 |
| Gateway(14) VIUS Table 908 "Synched VIU Record" = | 3000 |
| Gateway(14) VIUS Table 908 "Synched Central Host Record" = | 3000 |

Step 1010 "Gateway Alerts Central Host"

In the step 1010, the Gateway alerts the Central Host (corresponding to step 802 above), conveying information from the Gateway ViuInfo Table 906 ("First Data Record Id"=3004 and "Record Count"=1) to the Central Host.

The Gateway VIUS Table 908 is changed to reflect the fact that the Central Host has been "Synched" (Gateway to Central Host only):

| | |
|---|---|
| Gateway(14) VIUS Table 908 "Synched VIU Record" = | 3004 |
| Gateway(14) VIUS Table 908 "Synched Central Host Record" = | 3000 |

At the Central Host, a new Registry Table (904) entry is created with the Record ID="1002", and the information received from the gateway is recorded ("Data Ready Rec ID"=3004 and "Data Ready Rec Count"=1).

The Central Host VIUS Table 902 is unchanged.

| | |
|---|---|
| Central Host VIUS Table 902 "Last Data Record Transferred" = | 3000 |
| Central Host Registry Table 904, "Record ID" = | 1002 |
| Central Host Registry Table 904, "Data Ready Rec ID" = | 3004 |
| Central Host Registry Table 904, "Data Ready Rec Count" = | 1 |
| Central Host Registry Table 904, "Completed Rec ID" = | 0 |
| Central Host Registry Table 904, "Completed Rec Count" = | 0 |
| Central Host Registry Table 904, "Entry State" = | Ready |

Step 1012 "Central Host Requests Data from VIU"

In the step 1012, the gateway receives a request for data from the Central Host. This request informs the gateway of the sequence number of the first DPR to be uploaded (DPR #3004), and the count (1). The Gateway VIUS Table 908 is updated accordingly but the Gateway ViuInfo Table 906 remains unchanged.

| | |
|---|---|
| Gateway ViuInfo Table 906 "First Data Record Id" = | 3004 |
| Gateway ViuInfo Table 906 "Record Count" = | 1 |
| Gateway VIUS Table 908 "Synched VIU Record" = | 3004 |
| Gateway VIUS Table 908 "Synched Central Host Record" = | 3000 |

Step 1014 "Gateway Sends DPR to Central Host"

In the step 1014, the Gateway sends the DPR #3004 to the Central Host (corresponding to step 804 above).

The Gateway ViuInfo Table 906 and the Gateway VIUS Table 908 remain unchanged. There will be updates going to "description" field for internal tracking of upload.

Step 1016 "Central Host Receives Data"

In the step 1016, the Central Host receives the DPR #3004 (corresponding to step 806 above) and stores it in the DPR table for the VIU 32. The Central Host VIUS Table 902 is updated to show the "Last Data Record Transferred"=3004 and the Central Host Registry Table 904 is updated to reflect that 1 record (#3004) has been completed.

| | |
|---|---|
| Central Host VIUS Table 902 "Last Data Record Transferred" = | 3000->3004 |
| Central Host Registry Table 904, "Record ID" = | 1002 |
| Central Host Registry Table 904, "Data Ready Rec ID" = | 3004 |
| Central Host Registry Table 904, "Data Ready Rec Count" = | 1 |
| Central Host Registry Table 904, "Completed Rec ID" = | 3004 |
| Central Host Registry Table 904, "Completed Rec Count" = | 1 |
| Central Host Registry Table 904, "Entry State" = | Complete |

Step 1018 "Central Host Resyncs All Gateways"

In the step 1018, the Central Host sends a message to all pertinent gateways including the first and second gateways 14 and 16, in order to synchronize their records with the Central Host. This step corresponds to the step 314 above.

The Gateway ViuInfo Table 906 and the Gateway VIUS Table 908 of the first Gateway 14 will then have the following information.

| | |
|---|---|
| Gateway(14) ViuInfo Table 906 "First Data Record Id" = | 3004 |
| Gateway(14) ViuInfo Table 906 "Record Count" = | 1 |
| Gateway(14) VIUS Table 908 "Synched VIU Record" = | 3004 |
| Gateway(14) VIUS Table 908 "Synched Central Host Record"= | 3004 |

However the second gateway 16 that had transferred data for DPR #3000 previously would now look like this:

| | |
|---|---|
| Gateway(16) ViuInfo Table 906 "First Data Record Id" = | 3000 |
| Gateway(16) ViuInfo Table 906 "Record Count" = | 1 |
| Gateway(16) VIUS Table 908 "Synched VIU Record" = | 3000 |
| Gateway(16) VIUS Table 908 "Synched Central Host Record"= | 3004 |

The last entry (Synched Central Host Record) was updated in step 1018 to reflect the last record that the Central Host has received the DPR #3004, but the last set of DPRs actually forwarded by the second gateway 16 was one record, the DPR #3000.

This gateway state (showing their individual Synched VIU Records, and the common Synched Central Host Record) applies at all Gateways with respect to the given VIU 32.

Step 1020 "Quiescent State"

After the step 1016 is completed, the Central Host tables 902 and 904 contain the following information:

| | |
|---|---|
| Central Host VIUS Table 902 "Last Data Record Transferred" = | 3004 |
| Central Host Registry Table 904 "Record ID" = | 1002 |
| Central Host Registry Table 904, "Data Ready Rec ID" = | 3004 |
| Central Host Registry Table 904, "Data Ready Rec Count" = | 1 |
| Central Host Registry Table 904, "Completed Rec ID" = | 3004 |
| Central Host Registry Table 904, "Completed Rec Count" = | 1 |
| Central Host Registry Table 904, "Entry State" = | Complete |

At this stage, the most recent DPR received by the Central Host 12 is DPR #3004, but the (older) DPRs #3001–3003 have not yet been received because the communication between the VIU 32 and the gateway 14 was interrupted before they could be uploaded from the VIU.

Step 1022 "Second Gateway Collects Missing DPRs"

The VIU still retains all DPRs in its buffer. We assume here that the VIU 32 has not collected any new data in the mean time.

In the step 1022, after having established the WiFi connection with the second gateway 16, the VIU 32 sends a VIU Announce Packet 700 to the second gateway 16, with the contents of the SeqNumCurrent field 724 set to "3004" and the SeqNumCount field 726 set to "4". This step announces to the second gateway 16 that 4 DPRs are available, starting at count 3001.

The second gateway 16 will be aware of records successfully uploaded (#3000, #3004). It may collect only records #3001, #3002, #3003 from the VIU. As a result the second gateway 16 collects all records between the sequence number identified by the Synched VIU Record in its ViuInfo Table and the sequence number identified by the Synched Central Host Record in its ViuInfo Table, thus DPR #3001 to DPR #3003, constituting a second set of DPRs. These are collected in reverse order, DPR #3003 first, then DPR #3002, and lastly DPR #3001.

The second gateway 16 then updates its tables:

| | |
|---|---|
| Gateway(16) ViuInfo Table 906 "First Data Record Id" = | 3001 |
| Gateway(16) ViuInfo Table 906 "Record Count" = | 3 |
| Gateway(16) VIUS Table 908 "Synched VIU Record" = | 3000 |
| Gateway VIUS(16) Table 908 "Synched Central Host Record" = | 3004 |

Step 1024 "Second Gateway Sends Missing DPRs to Central Host"

The step 1024 "Second Gateway sends missing DPRs to Central Host" is analogous to the steps 1010 to 1016 above.

The second gateway 16 registers the VIU 32 as being "data ready" to the Central Host 12.

As a result, the Central host creates a new entry in the Central Host Registry Table 904 (Record ID=1003)

| | |
|---|---|
| Central Host VIUS Table 902"Last Data Record Transferred" = | 3004 |
| Central Host Registry Table 904, "Record ID" = | 1003 |
| Central Host Registry Table 904, "Data Ready Rec ID" = | 3001 |
| Central Host Registry Table 904, "Data Ready Rec Count" = | 3 |
| Central Host Registry Table 904, "Completed Rec ID" = | 0 |
| Central Host Registry Table 904, "Completed Rec Count" = | 0 |
| Central Host Registry Table 904, "Entry State" = | Ready |

The Central Host 12 then runs a query on the DPR table for the VIU 32 and retrieves a list of "gaps" in the DPR table starting at DPR #3001. It passes this list to the second gateway 16. Each "gap" is expressed as an entry containing three items: a list number; a first missing sequence number of the gap; and a last missing sequence number of the gap. In the present example the list of gaps is:

| | |
|---|---|
| List1 | 3001–3003 |
| List2 | 3005–Up |

The last entry on this list is the first DPR sequence number past 3004 (one past the sequence number of the most recent DPR received by the Central Host).

The Central Host then instructs the second gateway 16 to collect the missing DPRs from the disk store and to forward them to the Central Host.

Meanwhile, the VIU 32 collects more data from the vehicle and creates another DPR (#3005), which is also forwarded through the gateway 16 to the Central Host 12. If this event happens when Central Host (12) gets data it will be uploaded, if after the upload completes it will cause next notification with updated entry in ViuInfo table (receiving Gateway) and new entry in registration table on the Central Host (12).

After the Central Host receives the data and stores each DPR into the DPR table for the VIU 32, it updates the Central Host VIUS Table 902 and the Central Host Registry Table 904 accordingly (as per case when VIU generated additional record #3005):

| | |
|---|---|
| Central Host VIUS Table 902 "Last Data Record Transferred" = | 3004 -> 3005 |
| Central Host Registry Table 904,"Record ID" = | 1003 |
| Central Host Registry Table 904, "Data Ready Rec ID" = | 3001 |
| Central Host Registry Table 904, "Data Ready Rec Count" = | 3 |
| Central Host Registry Table 904, "Completed Rec ID" = | 0 -> 3001 -> 3002 -> 3003 -> 3005 |
| Central Host Registry Table 904, "Completed Rec Count" | 0 -> 1-> -> 3-> 4 |
| Central Host Registry Table 904, "Entry State" = | Ready -> Complete |

The Central Host Registry Table 904 entry "Completed Rec ID" and the Central Host Registry Table 904 entry "Completed Rec Count" are updated after each successful insert into DPR table. This is indicated by the successive "->" symbols above.

Step 1026 "Central Host Resyncs All Gateways Again"

Finally, in the step 1026 the Central Host resyncs all Gateways again, resulting in the following content of the relevant VIU tables in all gateways:

| | |
|---|---|
| Gateway(16) ViuInfo Table 906 "First Data Record Id" = | 3001 |
| Gateway(16) ViuInfo Table 906 "Record Count" = | 3 |
| Gateway(16) VIUS Table 908 "Synched VIU Record" = | 3005 |
| Gateway(16) VIUS Table 908 "Synched Central Host Record" = | 3005 |

The fact that all DPRs, up to #3005 have been received by the Central Host, is now reflected in the equal values of the "Synched VIU Record" fields (=3005) and the "Synched Central Host Record" fields (=3005) at all gateways.

In case the VIU re-synchronizes with the same gateway, i.e. the first gateway 14 in this example, the gateway will obtain only the missing records, that is those before DPR #3004. This happens typically when there is a new record generated by the VIU while the transmission is in progress and a fresh notification (VIU Announce Packet) is sent.

Conclusion

The vehicle telemetric system 10 thus provides a reliable and efficient method for collecting vehicle data over wireless LANs through a number of gateways, and into a central host, while taking into account the possibility of unreliable or intermittent communication.

Factors contributing to efficient use of distributed, non-contiguous WiFi Hotspots (WLANs) for VIU to Gateway to Central Host data extraction and communication are as follows:

the Gateway keeps a record of all numerically sequenced DPRs that it has uploaded from a given VIU. It will only upload a given DPR from a given VIU once, even if the VIU connects with the Gateway at different times and the VIU still contains the same DPRs;

the Gateway can upload as little as one DPR or as many DPRs as required (i.e. new DPRs that it has not yet uploaded) from a given VIU, as long as the WiFi link is maintained. The DPRs can be uploaded at a single Gateway or at multiple Gateways, depending on the travel of the vehicle (VIU), the distribution of Gateways and the time that the vehicle spends in the WiFi hotspot associated with each Gateway;

the Central Host synchronizes all Gateways after it uploads the needed DPRs from a given VIU (via a given Gateway). If a VIU enters the WiFi hotspot at a different Gateway following synchronization, the Gateway will not request the same data again;

in the event that the communication link between a given Gateway and Central Host is disabled temporarily, data from a VIU can still be uploaded to the Gateway at the afflicted gateway site. Only new data (i.e. DPRs) that the Gateway has not seen yet will only be uploaded to the Gateway. This is a type of intelligent store and forward approach. The Gateway will upload the data to the Central Host, after the communication link has been restored, if the Central Host requires part or all of the VIU's data. This store and forward approach from the Gateway to Central Host is also employed for remote sites, where dial-up modems may be employed and a constant connection between the two is not possible. Timed dial-ups would be used in this situation;

when a VIU enters a WiFi hotspot at a Gateway and data is transferred from the VIU to the Gateway, the most recent DPR is always transferred first. This ensures that the most recent vehicle information is sent up to the Central Host first (e.g. odometer setting), even if the transfer residency time in the WiFi hotspot is minimal;

if a newly commissioned VIU comes into communication range with a Gateway, the Gateway will only upload one DPR, as the VIU is 'unknown' to the Gateway at this time. The Gateway then solicits the Central Host to see if it wants this data. If the Central Host responds positively to the Gateway, it is only then that further DPRs will be uploaded to the Gateway, the next time the VIU establishes wireless communication with the Gateway. But if the Central Host does not request any data, the Gateway marks the VIU as one to be ignored the next time it comes within communication range of this Gateway. This minimizes WiFi traffic between VIUs and the Gateway. After a given time-out interval (typically a week), the Gateway will delete any knowledge it has of the ignored VIU. If the VIU comes within range of a WiFi hotspot again, the Gateway will repeat the above process, as if it was a newly commissioned VIU.

Modifications

While the preferred embodiment of the vehicle telemetric system 10 is based on a short-range wireless LAN technology using the 802.11b protocol standard, it is understood that other short-range wireless technologies and other wireless protocols are available already or evolving. The scope of the present invention is intended to encompass such alternative wireless technologies and protocols as well.

We claim:

1. A vehicle telemetric system, comprising:

a central host connected to a communications network;

one or more gateways connected to the communications network, the communications network enabling the transfer of packet data between the gateways and the central host;

a vehicle interface unit (VIU) within a vehicle having access to sensors in the vehicle for collecting vehicle related data, the VIU having means for communication over a wireless link of any of said gateways when the vehicle is within a transmission range of one of said gateways;

the VIU further comprising means for aggregating and formatting the vehicle related data into a data point record (DPR) including a unique sequence number and a vehicle identification number;

the VIU having a memory for storing a list of DPRs, and a VIU means for forwarding the DPRs to the one of said gateways over the wireless link;

each gateway having another memory for storing the DPRs received from the VIU, and a gateway means for forwarding the DPRs to the central host; and the central host having means for storing DPRs generated by the VIU and received from all gateways, and means for notifying each gateway regarding the sequence numbers and the vehicle identification numbers of the DPRs that have been already received at the central host.

2. A vehicle telemetric system as described in claim 1, wherein the DPR is of a size designed to fit into the payload of a layer 3 (network layer) packet, which in turn fits into a single packet of the wireless layer 2 (data link layer) protocol used for communicating over the wireless link.

3. A vehicle telemetric system as described in claim 2, wherein the wireless link is a short range wireless link.

4. A vehicle telemetric system as described in claim 2, wherein the layer 2 protocol used for communicating over the wireless link is the 802.11b protocol.

5. A vehicle telemetric system as described in claim 2, wherein the layer 3 protocol used for communicating between the VIU and the gateway is the Internet Protocol (IP).

6. A vehicle telemetric system as described in claim 3, wherein the size of each DPR transmitted in accordance with the 802.11b protocol is less than the Ethernet maximum transmission unit.

7. A vehicle telemetric system as described in claim 1, wherein the VIU means for forwarding comprises means for forwarding selected DPRs as instructed by the one of said gateways.

8. A vehicle telemetric system as described in claim 7, wherein the VIU means for forwarding selected DPRs comprises means for forwarding the selected DPRs in reverse order, starting with the most recently aggregated DPR.

9. A vehicle telemetric system as described in claim 1, wherein the means in the VIU for communication over the wireless link comprises announcement means for generating an announcement packet, including the sequence number of the most recent DPR, and a counter identifying how many DPRs are available to be forwarded to the one of said gateways.

10. A vehicle telemetric system as described in claim 9, wherein the announcement means comprises timing means for repeatedly transmitting said announcement packet at a time interval as long as the wireless link is activated.

11. A vehicle telemetric system as described in claim 10, wherein the timing means comprises means for changing the time interval to a longer time interval after a predetermined number of announcement packets have been sent.

12. A vehicle telemetric system as described in claim 1, wherein the DPR includes the following fields:

a header comprising a VIU serial number, a data length fields indicating the amount of vehicle related data aggregated in the DPR; and a data field, including a number of data points, each data point including an encoded data and a time offset at which the encoded data was collected from the vehicle.

13. A vehicle telemetric system as described in claim 1, wherein the central host comprises means for identifying gaps in continuity in the sequence numbers of the received DPRs (the missing DPRs) and informing the gateways of the gaps, and the gateways comprise means for requesting the missing DPRs from the VIU when the vehicle is within the respective transmission range.

14. A vehicle telemetric system as described in claim 1, wherein the VIU means for forwarding comprises a means for forwarding a first set of the DPRs to the one of said gateways over the wireless link when the wireless link is activated, and for forwarding a second set of the DPRs to another of said gateways over another wireless link when the another wireless link is activated, so that the first and second sets of DPRs form the complete said list of DPRs.

15. A vehicle interface unit (VIU) for a vehicle telemetric system, comprising a central host connected to a communications network and one or more gateways connected to the communications network, which enables the transfer of packet data between the gateways and the central host, the VIU being located in a vehicle and having access to sensors in the vehicle for collecting vehicle related data, the VIU having means for communication over a wireless link with any of said gateways, the wireless link being activated when the vehicle is within a transmission range of the one of said gateways, and another wireless link being activated when the vehicle is within a transmission range of another one of said gateways;

the VIU further comprising a means for aggregating and formatting the vehicle related data into a list of data point records (DPRs), each DPR including a unique sequence number and a vehicle identification number;

the VIU having a memory for storing the DPRs, and a VIU means for forwarding a first set of the DPRs to the one of said gateways over the wireless link when the wireless link is activated, and for forwarding a second set of the DPRs to said another of said gateways over the another wireless link when the another wireless link is activated, so that the first and second sets of DPRs form the complete said list of DPRs.

16. A VIU as described in claim 15, wherein the DPR is of a size designed to fit into the payload of a layer 3 (network layer) packet, which in turn fits into a single packet of the wireless layer 2 (data link layer) protocol used for communicating over the wireless link.

17. A VIU as described in claim 16 wherein the layer 2 protocol used for communicating over the wireless link is the 802.11b protocol.

18. A VIU as described in claim 16 wherein the layer 3 protocol used for communicating between the VIU and the gateway is the Internet Protocol (IP).

19. An access system for use in a vehicle telemetric system, the telemetric system comprising a central host connected to a communications network, the access system comprising:

one or more vehicle interface units (VIUs) and a gateway, the gateway being connected to the communications network, each VIU being located in a different vehicle and having access to sensors in the vehicle for collecting vehicle related data, each VIU having means for communication over a wireless link with the gateway, the wireless link being activated when the vehicle is within a transmission range of the gateway;

the VIU further comprising a means for aggregating and formatting the vehicle related data into a data point record (DPR) including a unique sequence number and a vehicle identification number;

each VIU having a memory for storing the DPRs in a list, and a VIU means for forwarding the DPRs to the gateway over the wireless link;

the gateway having another memory for storing the DPRs received from the VIU and a gateway means for forwarding the DPRs to the central host; and the gateway having means for requesting missing DPRs from each VIU, where the missing DPRs are those that have not been received by the central host.

20. An access system as described in claim 19, wherein the VIU means for forwarding comprises a means for forwarding a first set of the DPRs to the gateway over the wireless link when the wireless link is activated, and for forwarding a second set of the DPRs to the gateway over the wireless link when the wireless link is activated at another time, so that the first and second sets of DPRs form the complete said list of DPRs.

21. A method for monitoring a vehicle's performance in a vehicle telemetric system comprising a central host connected to a communications network, one or more gateways connected to the communications network, each gateway having a wireless transmission range, a vehicle interface unit (VIU) within a vehicle having access to sensors in the vehicle for collecting vehicle related data, the VIU having means for wireless communication with any of said gateways, the method comprising the steps of:

(a) in the VIU, collecting, aggregating and formatting the vehicle related data into data point records (DPR), each DPR including a unique sequence number and a vehicle identification number, and storing the DPRs as a list in a VIU memory;

(b) determining if the VIU is within the wireless transmission range of one of the gateways;

(c) forwarding a set of the DPRs from the VIU to the one of said gateways over a wireless link;

(d) forwarding some or all of the set of the DPRs received by the one of said gateways from the one of said gateways to the central host over the communications network; and (e) notifying each gateway by the central host regarding the sequence numbers and the vehicle identification numbers of the DPRs that have been already received at the central host.

22. A method as described in claim 21, wherein the step (a) comprises formatting the vehicle related data into the DPRs, each DPR being of a size designed to fit into the payload of a layer 3 (network layer) packet, which in turn fits into a single packet of the wireless layer 2 (data link layer) protocol used for communicating over the wireless link.

23. A method as described in claim 21, wherein the step (c) comprises forwarding selected DPRs as instructed by the one of said gateways.

24. A method as described in claim 23, wherein the step of forwarding the selected DPRs comprises forwarding the selected DPRs in reverse order, starting with the most recently aggregated DPR.

25. A method as described in claim 21, further comprising the step of generating an announcement packet by the VIU and sending it to the one of said gateways, the announcement packet including the sequence number of the most recent DPR, and a counter identifying how many DPRs are available to be forwarded to the one of said gateways, the step being performed before the step (c).

26. A method as described in claim 25, wherein the step of generating the announcement packet comprises generating the announcement packet repeatedly at a time interval as long as the wireless link is activated.

27. A method as described in claim 26, wherein the step of generating the announcement packet repeatedly comprises changing the time interval to a longer time interval after a predetermined number of announcement packets have been sent.

28. A method as described in claim 21, wherein the step (e) comprises the step of identifying gaps in continuity in the sequence numbers of the received DPRs (the missing DPRs) and informing the gateways of the gaps, and the step (c) comprises requesting the missing DPRs from the VIU when the vehicle is within the respective transmission range.

29. A method as described in claim 21, wherein the step (c) comprises forwarding a first set of the DPRs to the one of said gateways over the wireless link when the wireless link is activated, and for forwarding a second set of the DPRs to another of said gateways over another wireless link when the another wireless link is activated, so that the first and second sets of DPRs form the complete said list of DPRs.

30. A method as described in claim 21, wherein the step (d) comprises changing the format of the DPRs received by the one of said gateways before the DPRs are forwarded to the central host over the communications network.

31. A method as described in claim 30, wherein the step of changing the format comprises changing the format from a binary representation of the DPR to an ASCII representation.

* * * * *